United States Patent [19]

Kicherer et al.

[11] Patent Number: 4,993,553

[45] Date of Patent: Feb. 19, 1991

[54] ELECTRIC HOTPLATE STACKING AID

[75] Inventors: Robert Kicherer; Felix Schreider; Stefan Reif, all of Oberderdingen, Fed. Rep. of Germany

[73] Assignee: E.G.O. Elektro Gerate Blanc u. Fischer, Fed. Rep. of Germany

[21] Appl. No.: 303,318

[22] Filed: Jan. 26, 1989

[30] Foreign Application Priority Data

Feb. 9, 1988 [DE] Fed. Rep. of Germany ..... 3803806
Dec. 2, 1988 [DE] Fed. Rep. of Germany ..... 3840734

[51] Int. Cl.[5] ..... B65D 21/00

[52] U.S. Cl. ..... 206/499; 206/503; 206/518; 206/597; 206/821

[58] Field of Search ..... 206/499, 503, 512, 515, 206/516, 518, 597, 821

[56] References Cited

U.S. PATENT DOCUMENTS

| | | | |
|---|---|---|---|
| 2,594,287 | 4/1952 | Budd | 206/597 |
| 2,743,010 | 4/1956 | Koester | 206/597 |
| 2,812,856 | 11/1957 | Lantinberg | 206/516 |
| 2,896,207 | 7/1959 | Wilson | 206/597 |
| 3,045,101 | 7/1962 | Bremer | 219/37 |
| 3,221,396 | 12/1965 | Bremer et al. | 29/155.5 |
| 3,369,659 | 2/1968 | Ettlinger, Jr. | 206/503 |
| 3,771,646 | 11/1973 | Mascetti, Jr. | 206/518 |
| 3,777,885 | 12/1973 | Barteck | 206/503 |
| 3,937,322 | 2/1976 | Cohen | 206/499 |
| 4,142,634 | 3/1979 | Leff et al. | 206/516 |
| 4,407,414 | 10/1983 | Rey et al. | 206/516 |
| 4,596,440 | 6/1986 | Quam | 339/276 R |
| 4,781,628 | 11/1988 | Detter et al. | 439/748 |
| 4,818,846 | 4/1989 | Kicherer et al. | 219/458 |

FOREIGN PATENT DOCUMENTS

| | | |
|---|---|---|
| 0258590 | 3/1988 | European Pat. Off. . |
| 1987769 | 3/1968 | Fed. Rep. of Germany . |
| 1270201 | 6/1968 | Fed. Rep. of Germany . |
| 1465135 | 9/1972 | Fed. Rep. of Germany . |
| 2447755 | 4/1975 | Fed. Rep. of Germany . |
| 1935693 | 9/1976 | Fed. Rep. of Germany . |
| 3510895 | 10/1986 | Fed. Rep. of Germany . |
| 3540815 | 5/1987 | Fed. Rep. of Germany . |
| 3728528 | 8/1987 | Fed. Rep. of Germany . |
| 8712088 | 12/1987 | Fed. Rep. of Germany . |
| 2402949 | 4/1979 | France . |

*Primary Examiner*—David T. Fidei
*Attorney, Agent, or Firm*—Eckert Seamans Cherin & Mellott

[57] ABSTRACT

An electric hotplate has a hot plate body and plugging pieces for connection to connecting members of supply lines. A stacking aid is provided for receiving a plurality of hotplates in a multilayer stack, the stacking aid having pallet plates providing receptacles for receiving the plugging pieces of each single hotplate laterally outside of each single hotplate.

16 Claims, 12 Drawing Sheets

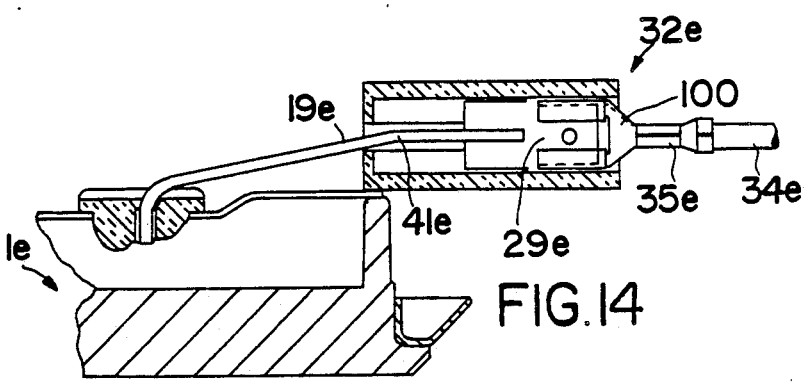
FIG.14
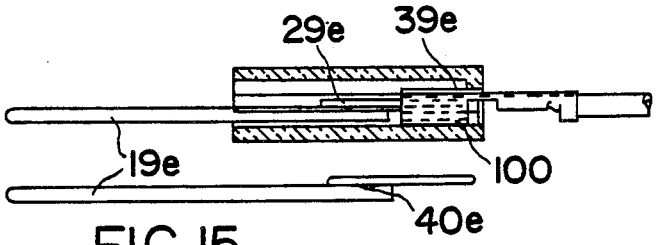
FIG.15
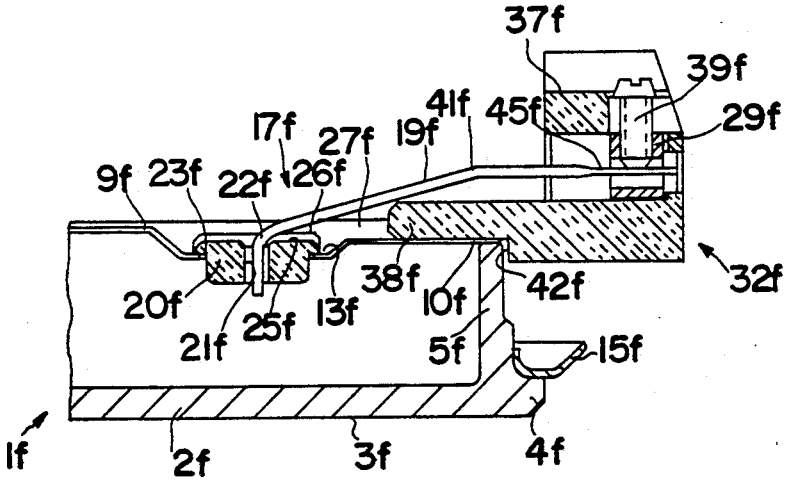
FIG.16
FIG.18
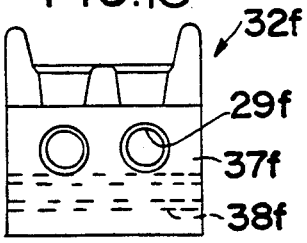
FIG.17
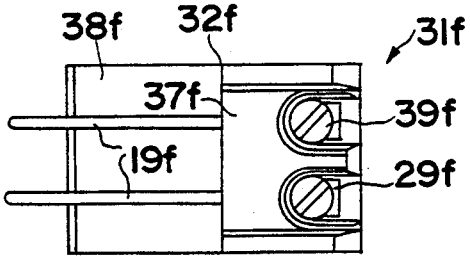

ELECTRIC HOTPLATE STACKING AID

BACKGROUND OF THE INVENTION

The invention relates to an electric hotplate with a hotplate body having connecting means for connection to apparatus lines. These connecting means in particular have connection portions leading away from the underside of the hotplate body and which belong to the heating resistor leads, whose position is substantially fixed with respect to the hotplate body. The connecting portions are advantageously formed by wire portion-like pins, which are admittedly inherently rigid under the forces occurring, but are also resiliently movable within certain limits.

Such electric hotplates are generally fixed in a hob in such a way that they engage in the assembly or mounting opening of said hob, are supported against the bearing forces with respect to the rim of said mounting opening and are connected at the underside of the hob to the apparatus lines belonging thereto. Although this connection offers very high reliability and safety if at least partly constructed as a plug or welded connection in such a way that with the apparatus lines is associated a connecting piece with an insulator, which is only connected to the electric hotplate or the connection portions on fitting the electric hotplate into the hob, but such a connection is not satisfactory for all the available or assembly or fitting processes. Particularly if there can or is to be no welded connection or if the electric hotplate is inserted in the hob with an insulator already arranged thereon, or a construction of apparatus lines is to be used in which the connecting members of said lines have no insulator, the said known constructions are unsuitable.

The problem of the invention is to provide an electric hotplate of the aforementioned type, which ensures a very simple assembly and an uncomplicated electrical connection, particularly if the apparatus lines are provided with the simplest possible connecting members at their ends.

According to the invention this problem is solved in the case of an electric hotplate of the aforementioned type in that the particular or each connecting pin has an in particular separate plugging piece which, in one or two directions at right angles to one another, is advantageously enlarged several times in cross-section compared with the wire cross-sections of the pin and forms a preassembled unit with the hotplate body. Thus, the apparatus lines, having at their ends as connecting members e.g. matching plugs or only multicore cable ends and which require no preassembled insulator connected thereto, can be connected to the plugging portions by a plugging process and as a result of their size and preassembled arrangement ensure a very safe and reliable electrical connection.

The plugging portion could admittedly be electrically conductively or mechanically rigidly connected to the connecting pin by crimping, appropriate one-piece shaping of the pin, a further plug connection or the like, but as a rule preference is given to a connection by spot welding, because this can be performed very easily during the manufacture of the electric hotplate, i.e. prior to its fitting in the hob.

It is also conceivable to construct the plugging piece as a negative plug with a plugging opening, as a substantially axially symmetrical or at least approximately circular or cylindrical plug pin or the like, but a very simple construction is obtained if the plugging piece is constructed as a flat plugging tongue, whose thickness need only be approximately the same as the diameter of the connecting portions and which as a commercially available standardized part is suitable for connection to matching plugs, which can be very easily fitted to the apparatus lines, e.g. by crimping. In order to bring about a space-saving housing of the adjacent plugging pieces of an electric hotplate, the largest cross-sectional extension of said plugging pieces is appropriately roughly at right angles to the plane of the cooking surface of the hotplate body and all the plugging pieces appropriately project forwards to the same extent and are arranged symmetrically to a common median plane parallel to the cooking surface.

A particularly advantageous further development of the invention provides for an insulator being provided for at least one plugging piece and in particular for all the plugging pieces together and said insulator can preferably be mounted from the free end of the plugging piece or pieces and therefore can be assembled following the fitting of the plugging pieces to the connecting portions, so that it is in no way prejudicial to said fitting operation. This insulator, which need only be mounted during the assembly of the electric hotplate in the hob, also appropriately forms a preassembled component of the hotplate body, i.e. prior to the installation of the plate in the hob, the insulator is at least partly placed on the particular plugging piece or the connecting portions and is fixed in this position in an appropriate manner so as to prevent automatic or accidental loosening.

Particularly if the plugging pieces or insulator in a view of the cooking surface of the hotplate body project at least partly over the circumference of a radially outer, downwardly projecting, circular flange rim of the hotplate body or even over the outer circumference of the complete hotplate body, difficulties can occur during the tight stacking of a plurality of such hotplates in a transportation stack. An advantageous hotplate stacking means can e.g. be gathered from German patent application P 37 28 541.6, to which reference should be made for further details. According to the invention, for such a stacking means it is in the present case provided that the stacking portion or portions or the plugging portion or portions or the insulator or insulators can be transferred from a stacking position into an assembly or connection position by means of resilient or bending deformation of the lead or leads, by pivotable or displaceable mounting supports of at least one of said parts or by similar measures and in which they are located further below the underside of the hotplate body and/or have a modified radial spacing from the circumference of the hotplate body or its central axis. In the stacking position, the corresponding parts are located appropriately between the planes of the top surface, i.e. the cooking surface, and the underside, i.e. roughly the plane of the lower circular face of the outer flange rim, so that the electric hotplate in the stacking state has no parts projecting outwards over said planes and consequently a minimum stacking height is obtained. Any necessary, hinge-like limited bending zones for transfer between the stacking position and the connecting position can be formed by weakened cross-sectional areas, by bent zones or the like of the leads, which are appropriately located as far as possible from the plugging piece, namely e.g. in the vicinity of the fixing of the connecting portions with respect to the hotplate body. This fixing is mostly brought about by an insulator fixed in the underside of the hotplate body, e.g. by fixing to a lower cover plate, which traverses the leads and on whose underside they are bent against the outer circumference of the hotplate body.

It is particularly advantageous for the finally assembled, i.e. the specified position of the insulator, if said assembly position is fixed by at least one securing member, whereby said securing can take place with respect to the hotplate body, the connecting pin and/or preferably the plugging piece. If the securing member is constructed as a self-locking snapping member or the like, then the retaining engagement is automatically obtained during the transfer of the insulator into its assembly position.

For a securing engagement of the insulator in the hotplate body, in its final assembly position the insulator appropriately engages on the face or the outer circumference or on both the said surfaces of the outer flange rim of the hotplate body, a small spacing with respect to said surfaces also being conceivable. As a result of this engagement on the one hand and the retaining element on the other, the insulator is locked in both movement directions roughly parallel to the connecting pins, so that it substantially forms a positionally rigid support of the plugging pieces with respect to the hotplate body, which only has to be engaged during the installation of the electric hotplate and which previously does not in any way impede the mobility of the plugging pieces, particularly at right angles to the plane of the cooking surface. Following the introduction of the insulator into its final position an orientation aid is provided, through which the plugging pieces are secured oriented in a precisely defined position and can also be connected using robots. Such a fully automated production is also possible in connection with the remaining assembly of the inventive electric hotplate.

The connecting portion of the hotplate appropriately extends at the most up to the outer circumference of the hotplate body or at the most to the inner circumference of the outer flange rim and preference is given to constructions according to DE-OS 35 40 816, to which reference can be made for further details. Thus, an electric hotplate constructed in said known manner can either be used for the connection possibilities described therein or, for the presently described connection possibilities only requires the fitting of plugging pieces or insulators. As in the present case the pins are relatively short, it is appropriate to provide a wire or flat bar-like connecting portion between the plugging piece located outside the outer circumference of the outer flange rim or the hotplate body and its flat extension is appropriately parallel to the cooking surface of the hotplate body, so that it forms a relatively easily bendable hinge portion at right angles to the cooking surface. This connecting portion can be constructed in simple manner in one piece with the plugging portion, e.g. as a stamped bent part.

However, it is also conceivable for the particular connecting pin to extend a relatively long way beyond the outer circumference of the outer flange rim or the hotplate body or for it to be constructed according to DE-OS 35 40 815, to which reference should be made for details. In this case, the pin can laterally overlap the plugging portion over part of its length or to such an extent that it approximately extends up to the plugging portion of the plugging piece to be engaged for producing the plug connection.

It is appropriate if the plugging piece has an in particular flat fixing portion with which the connecting pin is engaged. The weld can be provided on a flat or lateral face of the plugging piece, so that the latter projects laterally only roughly by its thickness over the connecting pin. In order to ensure a precisely defined and therefore particularly reliably performed welded joint, the plugging piece is provided for the purposes of receiving the weld with a stamped out am or some similar stud or fin-like protuberance. The end of the connecting portion or pin can be flattened by crimping or the like, so that it has a smaller cross-sectional extension in one direction and a larger cross-sectional extension at right angles thereto than the remaining lead and consequently ensures a reliable connection with the plugging piece.

Instead of or in addition to the described constructions, it is also advantageously possible to provide on the plugging piece at least one clamping screw, which advantageously engages in a plugging hole of the plugging piece, in which the connecting pin and/or connecting member are inserted in overlapping manner and can be fixed with the clamping screw. This permits the advantageous electrical connection of at least one or all the connecting pins of the electric hotplate. Instead of or in addition to the described constructions, it is also possible to connect at least one or all the pins of the hotplate directly to the connecting member of the apparatus line, e.g. by a welded joint. Without using further parts, the connecting member is directly formed by the associated apparatus line end or preferably by a multicore cable end, which is fixed by crimping or the like to said line end and holds together the individual wire strands of the flexible apparatus line in the form of a holder. Possibilities of such a construction can be gathered from German patent application No. P 37 28 528.9, to which reference should be made for details.

For the connection of electric hotplates, it is also possible to use at least one socket as an electrical plugging connection, the electric hotplates generally being connected in two, three or four-pole manner. Such sockets appropriately have an electrically conductive socket body, which provides a cable connection for the electrically conductive and mechanically secured connection to the electric lead cable forming a plugging part optionally linearly connected thereto for mounting on a plug. In order to secure the socket against withdrawal counter to its mounting direction, in addition to its non-positive or frictional connection to the plug and with respect to at least one of the components engaged therewith, advantageously on the socket body is provided a rearwardly directed or acting withdrawal stop, which can secure the socket, e.g. against withdrawal from an insulator surrounding it or some other of the said components.

Thermally or similarly loaded, electrical plugging connections, particularly those provided on electric hotplates and which are continuously exposed to severe temperature fluctuations, over a period of time can become so loose as a result of scaling, corrosion and the like, that the electric line connection is interrupted. However, such plugging connections are desirable as a result of the simplicity of fitting and due to the easy replaceability of the unit to be electrically connected.

In order to solve the problem of the invention or in order in particular to provide a socket of the aforementioned type which, in the case of simple construction and easy fitting, ensures a further improved and particularly durable position fixing in the plugged state, it is inventively provided that the socket body has an advance stop, which rigidly limits the plugging movement of the socket in its plugging direction with respect to a further component, particularly one which is separate from the plug, so that the socket can assume a precisely defined end position with respect to its movement direction, or conversely the further component, particularly the insulator, can be mounted on the socket in such a way that it assumes a precisely defined end position with respect thereto. The advance stop is advantageously located behind the front end of the plugging part or behind the centre of its length, or even behind the complete plugging part, so that it is positioned outside the zone where particularly high temperatures or thermal and/or electrical stresses can occur. Preferably, in addition to the advance stop, there is at least one withdrawal stop acting in the opposite direction, so that the socket can be positionally secured in both opposite directions in an almost clearance-free and non-positive manner with respect to the further component or components.

The insulator is mostly used for orienting or aligning the leads of the electric hotplate provided with the plugs with respect to the hotplate body, e.g. in that the insulator engages with alignment surfaces in the vicinity of the underside on the hotplate body or on its outer flange rim. In the case of said positional fixing of the socket with respect to the insulator by stops, the socket is kept in precisely oriented manner relative to the hotplate body, or conversely the insulator is not only secured against movements towards the central axis of the hotplate body in that it engages with corresponding shoulder faces on the outer circumference of the hotplate body, but it is also non-positively secured against movements in the opposite direction in that it is arrested by the advance stop of the socket.

The advance stop can have a limited, relatively rigid elasticity, so that it gives way slightly due to the counterpressure of the counterstop, e.g. up to the time when the withdrawal stop has reached the stop position, the advance stop moving back following relief, so that the further component having the counterstops is then pretensioned and is held in clearance-free manner between the stops. However, the advance stop can also be constructed in a substantially positionally rigid manner with respect to the socket and in this case there can also be a small longitudinal clearance of the socket between the two stop positions for corresponding uses. The socket is also suitable for other electrical plug connections than that of electric hotplates.

It is admittedly conceivable to form at least one advance and/or withdrawal stop by a separate part fixed to the socket or socket body, but the particular stop is preferably constructed in one piece with the socket body. Appropriately all the stops, particularly all the advance stops, are shaped in one piece onto the socket body. The particular stop can e.g. be formed by a simple leg or web-like bend of the socket body and in each case the particular stop appropriately projects outwards over the outside of the outer boundary planes of the plugging part or is completely located outside the plugging opening. In addition, the advance stop can also be formed by a forwardly directed surface or edge at right angles to the plugging direction and which is in any case already provided on the socket body. This is in particular constituted by the leading edges of a clamp-like, rear shank end of the socket body used for embracing the associated end of the insulating casing of the cable connected to the socket to form a unit.

In order to obtain an even more precisely defined stop position, either only a single advance stop is provided, or at the most two advance stops are provided, which are preferably located in the same stop plane and not, as is also conceivable, reciprocally displaced in the longitudinal direction of the socket. The same advantageously also applies with regards to the withdrawal stop.

The counterstop for the withdrawal stop or stops could also be located within the further component, particularly the insulator, but the reaching of the stop position can be controlled particularly advantageously if said counterstop is formed by the rear end face of the insulator or the like. The counterstop for the withdrawal stop is appropriately located behind the centre of the length of the insulator within the same. It can have a spacing from the counterstop for the advance stop or from the rear end face of the insulator, which is at the most as large as the material thickness which must be provided for maintaining an adequate insulator strength between the counterstops.

If the advance stop and the withdrawal stop are located on remote sides, particularly flat sides of the socket, in particular the withdrawal stop can be engaged in simple manner in its stop position by small tilting movements of the socket in the manner of a locking or snapping member. However, if said stops face one another on the same side of the socket, the engagement by transverse movements can in particular be facilitated if the e.g. single advance stop is laterally displaced with respect to the withdrawal stop or with respect to the median longitudinal plane of the socket. However, in any case, the stop or stops are located laterally within the lateral edges of the plugging part and/or laterally outside the cable connection shaft.

The socket body is appropriately constructed as a sheet metal shaped stamped bending part, so that the plugging part forms on one side a longitudinal gap, which is bounded by facing longitudinal edges of two sleeve or bending strips or flaps. The latter, e.g. by beading the longitudinal edge regions, can form elongated contact springs, which engage or slide with a relatively high spring tension on the plug. However, such beads generally only have a linear contact engagement, which can lead to high surface pressures and to undesired difficult fitting, which is particularly advantageous if several sockets combined into a unit are to be simultaneously mounted on a corresponding number of plugs, because then the difficult fitting can then be increased by the factor of said number. Despite the good contact resilience, this can be avoided in that the contact springs are constructed in leaf or strip-like manner and consequently form a correspondingly wide sliding or engagement surface for the flat plugs. The total width of said sliding or engagement surface on one side of the plugging part can e.g. be approximately half the width of said flat side. It is also advantageous if the contact springs are set back with respect to the front and/or rear end of the plugging part, or are shorter than the latter. The effective engagement or bearing surface for the plug can have a length which is smaller than half the length of the plugging part.

A further important advantage can be obtained in that the particular contact spring forms at the front end an insertion bevel for the flat plug, which can e.g. be achieved in that the front end connects in one piece to the casing of the plugging part, whereas both the lateral edges of the contact spring are free or exposed and one lateral edge can be directly formed by the longitudinal edge of the associated sleeve flap. Each of the two juxtaposed contact springs, whose rear ends can also pass in upwardly sloping, one-part manner into the casing or sleeve flap of the plugging part, extends over more than half the width of the associated sleeve flap.

A particularly advantageous further development of the invention is constituted by the fact that facing contact springs engaging on opposite sides of the plug are provided. Appropriately, in each case two contact springs face one another pairwise and can have approximately the same width. However, the facing contact springs appropriately have varyingly long sliding or engagement faces. One contact spring by in side view flat curved construction forms an approximately only linear sliding or engagement face over its width, as well as the portions rising at an acute angle, whilst the other contact spring has a longer, approximately linear top or vertical portion, which passes into obtuse-angled end portions. The contact springs forming curved or linear sliding and engagment faces are appropriately located in the vicinity of the sleeve flaps, whilst the contact springs with the elongated top portion are advantageously directly connected on either side by means of waste-free stamped edges to the lateral edges of the withdrawal stop. The free, rearwardly directed end of said withdrawal stop appropriately projects in acute angled manner over the associated outside of the plugging part and its front and rear end can substantially coincide with the associated ends of the adjacent contact springs, so that the length ratios given for the same can also apply with respect to the withdrawal stop.

As a result of the described construction, the plugging part is formed by a front and a rear, in each case clamp or clip-like casing part, which are interconnected by means of several longitudinal webs distributed in spaced manner over the circumference or whose connecting part has several circumferentially distributed longitudinal slots, whereby lateral, planar longitudinal webs located on the narrow sides of the plugging part can be narrower than the latter and can be slightly wider than the plug thickness. The longitudinal webs on the flat sides are exclusively formed by the contact springs.

For the locking longitudinal securing of the socket with respect to the plug, the socket can have a spring cam projecting into its plugging opening between its ends and which engages in a corresponding depression or opening of the plug. According to the invention, said spring cam is provided in the vicinity of the sleeve flaps and not on the side facing the latter, but as a result of corresponding shaping of the longitudinal edges of said sleeve flaps, it is still in the median longitudinal plane of the plugging part. In order that the longitudinal slot between the sleeve flaps does not for this purpose have to be laterally displaced with respect to the median longitudinal plane over the entire length thereof, it is only displaced in the vicinity of the spring cam, whereas the forwardly and/or rearwardly connecting longitudinal portions of the longitudinal slot are located in said median longitudinal plane. This also leads to a flap-like projection, which projects laterally and carries or forms the spring cam and which ensures particularly good spring characteristics. It is advantageous in this case if the spring cam is located in the vicinity of or on a contact spring and is slightly forwardly displaced with respect to its apex or with respect to the centre of its length, so that it is inclined in cross-section under a few radians in the direction of the plugging end of the socket and is directly connected to the insertion bevel.

These and further features of preferred further developments of the invention can be gathered from the claims, description and drawings, whereby the individual features can be realized singly or in the form of subcombinations in an embodiment of the invention and in other fields and constitute advantageously, independently protectable constructions, for which protection is hereby claimed.

Embodiments of the invention are described in greater detail hereinafter relative to the drawings, wherein show:

BRIEF DESCRIPTION OF THE DRAWINGS

FIGS. 14 and 15: Another embodiment in views corresponding to FIGS. 4 and 5.

FIGS. 16 and 17: Another embodiment in views corresponding to FIGS. 8 and 9.

FIG. 18: The insulator according to FIG. 16 in a view from the right.

DESCRIPTION OF THE PREFERRED EMBODIMENTS

Figure 1:
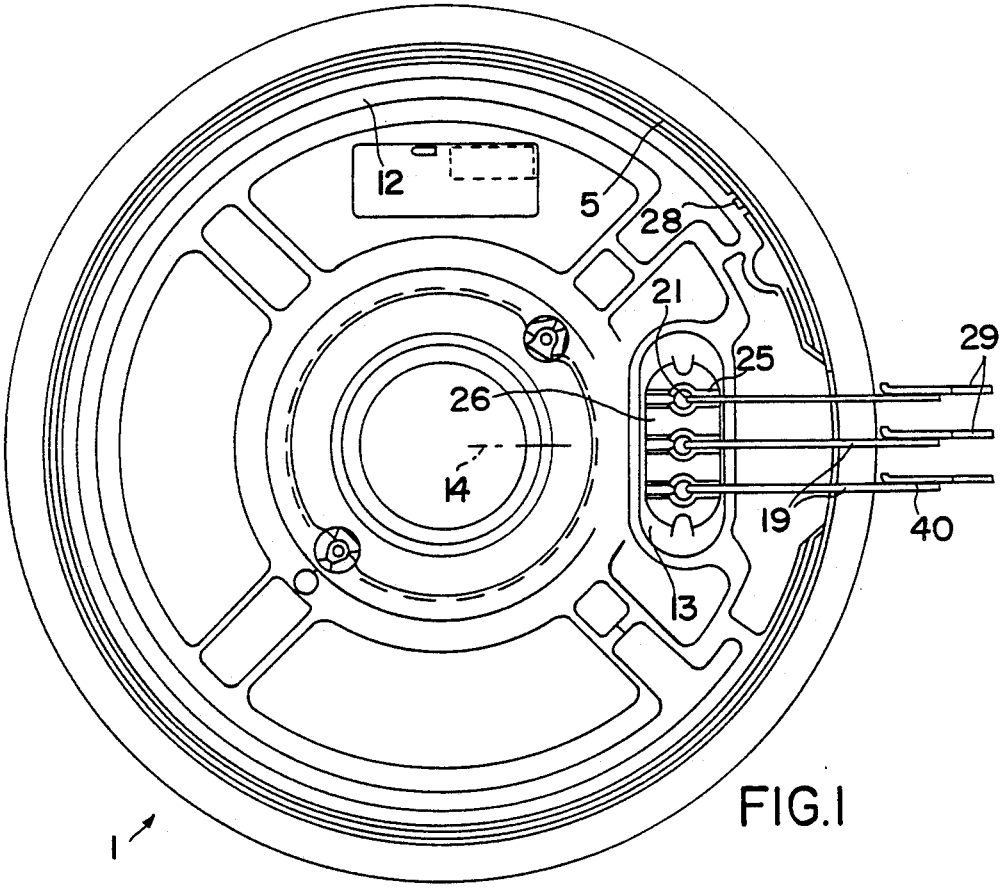
FIG. 1: An inventive electric hotplate in a view of the underside.
Figure 2:
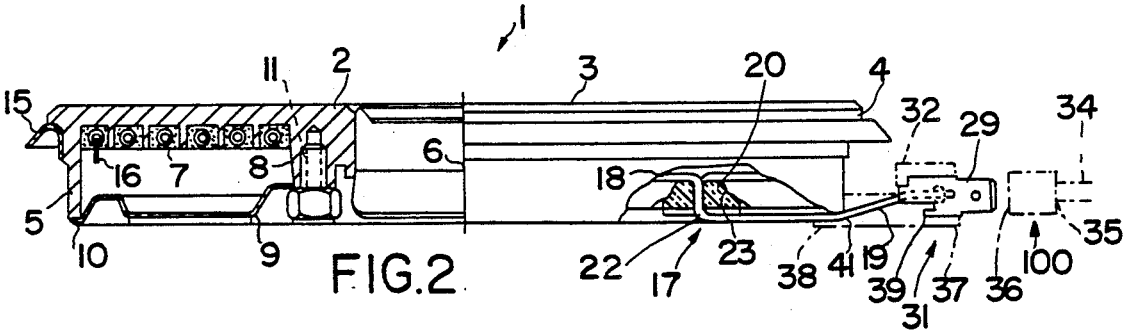
FIG. 2: The electric hotplate according to FIG. 1 in a part section.
Figure 3:
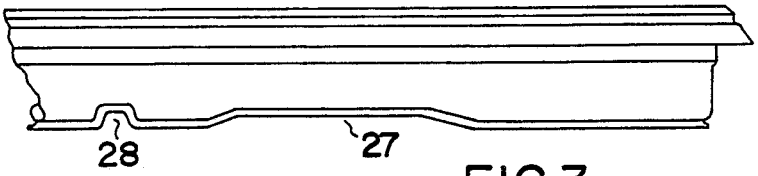
FIG. 3: A detail of the electric hotplate in a view from the right according to FIG. 2, but without connecting means.

The electric hotplate 1 according to FIGS. 1 to 3 has a one-part, cast metal hotplate body 2, which forms on the top surface a planar, circular cooking surface 3, which in the represented embodiment as an automatic hotplate is centrally provided with an opening for the reception of a temperature sensor and is closed throughout in the case of a power-controlled, normal hotplate. The hotplate body forms on the outer circumference a circumferential collar 4 and slightly inwardly displaced with respect thereto on the underside a projecting, outer flange rim 5 and is generally constructed in a rotationally symmetrical manner about its central axis 6. Within the flange rim 5 and in the underside of the hotplate body 2, are laid one or more heating resistors 7 in the form of heater coils, which are embedded in grooves passing round the central axis 6 in a mineral, moulded insulating material. This circular, heated zone is bounded on the inner circumference by an inner flange rim 8 projecting less far than the flange rim 5. In the case of hotplate bodies with a closed surface a one-part central pin projects centrally on the underside and is then used in place of the flange rim 8 for fixing a lower covering 9 in the form of a sheet metal cover, which is supported with its outer circular rim 10 on the face of flange rim 5 and is fixed with screws 11 or the like.

The profiled covering 9 forms on the underside depressions 12, 13, whereof one approximately oval depression 13 is approximately symmetrical to an axial plane 14 of the hotplate body 2. To the outer circumference of the hotplate body 2 is fixed a bearing ring 15 supported on the circumferential collar 4 and which in the fitted state of the electric hotplate 1 engages over the edge of the assembly opening in the hob and is tensioned against the top of the hob.

As a rule, each heating resistor 7 is provided at both ends with a short end pin 16 projecting downwards out of the insulating material and which is used for connection to an associated lead 17, which also forms part of the preassembled electric hotplate 1. Each lead 17 has a portion 18 located within the covering 9 and connected to the associated end pin 16, e.g. by spot welding and a connecting pin 19 located outside the covering 9 or the hotplate body 2 substantially on the underside thereof and is in one piece from end pin 16 to the end of connecting pin 19. A ceramic material, e.g. steatite insulator 20 is inserted in a corresponding window-like opening 23 of cover 9 in the vicinity of depression 13 and is provided with a through-opening for each lead 17. On either side of said through-opening 21, each lead 17 is in each case bent once, either in the opposite or same directions and is consequently fixed at right angles to the cooking surface 3. The outer or lower bend 22 can form a hinge zone for the associated connecting pin 19 with a hinge axis approximately at right angles to the axial plane 14. On the lower or outer face 26, insulator 20 is provided with a groove-like cutout 25 for each connecting pin 19 or lead 17, said cutouts 25 being linked with a reception depression 27 formed in the underside of covering 9 and also in the lower face of the flange rim 5, as well as the circumferential part of circular rim 10 engaging in the associated area. Despite leading out over the outer circumference of the flange rim 5, at least in one stacking position all the pins 19 can be arranged in such a way that they do not project over the plane of the underside of the hotplate body 2 or the covering 9 or its circular rim 10, the latter appropriately forming the lowest area of covering 9 and the complete hotplate 1 in the stacking state.

In the circumferential direction and spaced from the reception depression 27 is provided in the underside of electric hotplate 1 a positioning member 28 for the precise rotational orientation of hotplate 1 during assembly and said positioning member 28 is appropriately formed by a groove-like cutout in the face of flange rim 5 and a stamped out tongue in circular rim 10, which on the one hand engages in said cutout and on the other hand bounds a downwardly opening positioning opening somewhat smaller than said cutout. Thus, covering 9 is precisely fixed in its rotary position with respect to the hotplate body 2.

At the end of each of the equally long connecting pins 9 is fixed a plugging portion 29, whose plugging direction is approximately radial to the electric hotplate 1 or approximately parallel to the axial plane 14, whilst being directed outwards. Each of the completely substantially planar plugging portions 29 is fixed by a lateral flat surface laterally to the circumference of the associated pin 19 by spot welding, so that in plan view of the hot-plate it extends with its rear end approximately up to the outer circumference of hotplate 1 or bearing ring 15. The plugging portions 29 are formed by flat plugging tongues. With each plugging portion 29 is associated a matching plug 100, particularly a socket, which is fixed by means of a crimped connection 35 to the associated end of an apparatus line 34 and forms a plug opening 36 for receiving the plugging portion 29.

Apart from showing the matching plug 100, FIG. 2 shows in dot-dash form an insulator 32, which appropriately surrounds over at least part of their length and substantially over the entire circumference all the plugging pieces 29, so that a connecting piece 31 preassembled with the electric hotplate 1, together with all the electrical connecting parts in the form of plugging portions 29 is formed. An optionally provided earthing connection is fitted separately therefrom, e.g. to the covering 9. Therefore insulator 32 forms a casing 37 at least receiving the rear ends of plugging portions 29 and a substantially flatter tongue 38 rearwardly connected thereto and which is provided with a step in such a way that it can engage both on the outer circumference of flange rim 5 and on the underside in the vicinity of the circular rim 10. FIG. 2 shows the stacking position of plugging portions 29, in which the pins 19 can still be in metallic contact with the covering 9. In this stacking position, the insulator 32 is not in the represented position and is instead in a different securing position on the hotplate body 2. The plugging pieces 29 are e.g. jointly pivoted downwards out of the stacking position, so that the leads 17 are completely contact-free with respect to hotplate body 2 and covering 9 and in this connection position the insulator 32 engages in the described manner on electric hotplate 1. Each plugging portion 29 has a securing member 39 bent laterally out of the same in one piece in the form of a rearwardly sloping, barb-like snapping tongue, with which is associated a locking opening or shoulder in the insulator 32.

If the insulator 32 is mounted on the plugging portions 29 from the rear ends thereof, on reaching the end or final assembly position of insulator 32, the securing members 39 pass into the locking openings and simultaneously tongue 38 engages in the described manner on hotplate 1, so that the insulator is locked in both directions or can be braced between the electric hotplate 1 and the plugging portions 29. The reception depression 27, in which leads 17 or pins 19 are in the stacking position, is made sufficiently wide that it can receive any number of pins 19, namely e.g. two to four juxtaposed pins 19. Each plugging portion 19 is fixed by a spot weld 40 to the associated pin 19.

As is shown in FIG. 2, between the insulator 20 or bend 22 the connecting pin 19 is provided with at least one bend 41, which in the side view according to FIG. 2 is appropriately in obtuse angle form in such a way that the plugging portion 29 is located in the stacking position between the boundary planes of the electric hotplate 1 and is oriented radially with respect to the central axis 6. In the represented embodiment, there is a bend 41 in the vicinity of the face of flange rim 5 or circular rim 10 and a bend laterally in the vicinity of the rear end of plugging portion 29. This inventive bend 41 can also be provided in the case of hotplates constructed differently from those described herein, e.g. for electric hotplates, in which there is no connecting piece at the end of the pins and instead said pins terminate freely.

Bend 41 is appropriately located between bend 22 and the end of pin 19 in such a way that it can be appropriately pivoted into the vicinity of the face of flange rim 5. However, it can also be located further inwards or outwards with respect to the said flange rim 5 radial to the central axis 6, as can be gathered from FIGS. 4 to 17. However, its radial spacing with respect to the flange rim 5 is only approximately the same as its thickness. The angle of bend 41 is appropriately such that when lead 17 is swung against the underside of the hotplate body the portion of pin 19 located radially outside bend 41 slopes in the direction of the plane of cooking surface 3, whilst the linear portion of pin 19 positioned radially within bend 41 is provided up to bend 22 parallel to cooking surface 3 or the underside of hotplate body 2 and is completely embedded within the underside of electric hotplate 1.

The angle of bend 41 is selected in such a way that if the lead 17 in its operating position is swung away from the underside of hotplate 1, the free end portion of pin 19 or plugging piece 29, with respect to its plugging direction, is at least approximately or substantially oriented parallel to the cooking surface 3. However, it can also be at an angle diverging slightly therefrom, e.g. by approximately +/−10°.

A further particularly advantageous development of the invention is constituted by at least one and particularly all the plugging portions 29 instead of being located in the standing position, are arranged in such a way that their greater cross-sectional extension is approximately parallel to the cooking surface. The particular plugging portion 29 in the stacking position and/or in the assembly or operating position is appropriately parallel to the cooking surface 3, so that e.g. all the plugging pieces 29 are located in a common plane. Intermediate stages or positions can also be advantageous. Such an arrangement is particularly suitable for those electric hotplates which have a small number of connections, e.g. only two or three connections. This construction can economize on a relatively considerable part of the fitting height.

In FIGS. 4 to 25 the same reference numerals are used for the corresponding parts, but are followed by different letter references, but the corresponding descriptions apply to the corresponding parts.

As shown in FIGS. 4 to 7, for the reception of each plugging part **29*a*, casing 37*a* of insulator 32*a* has a through-opening adapted to the cross-section thereof and which extends into the vicinity of tongue 38*a* and continues rearwards therein over and beyond the back of the casing 37*a* as a trapezoidal groove, so that on mounting insulator 32*a*, the plugging portions 29*a* are firstly inserted in said grooves at right angles to their plugging direction and then by relative movement the insulator 32*a* can be moved into its end position roughly parallel to the plugging direction of plugging pieces 29*a* until the securing members 39*a* lock and the stepped face of tongue 38*a*** engages on the intimated electric hotplate.

Figure 4:
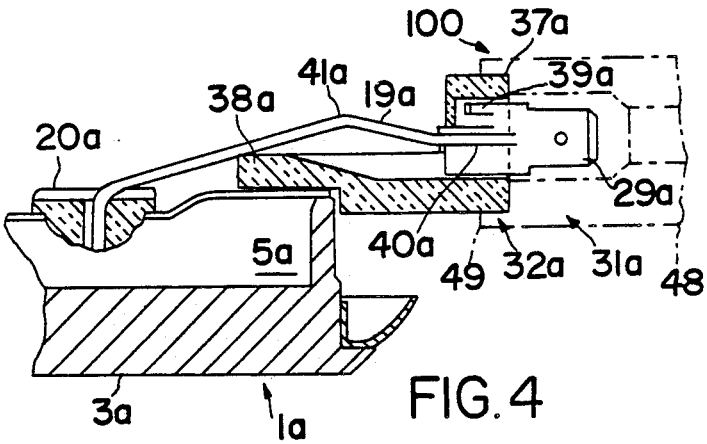
FIG. 4: Another embodiment of connecting means of a hotplate in cross-section at right angles to the cooking surface.
Figure 7:
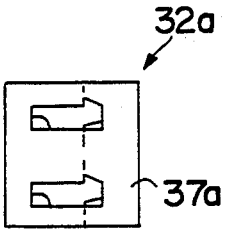
FIG. 7: The insulator according to FIG. 5 in a view from the right.

As indicated in dot-dash line form in FIG. 4, the matching plug 100 can be provided with the or an insulator 48, which appropriately surrounds substantially over the entire circumference and/or the entire length the metal or live parts of the matching plug. Instead of constructing said insulator in such a way that it also forms the insulator for the plugging pieces, connecting pins, etc., its construction is appropriately such that it forms a part connected in substantially gapless manner to insulator **32*a*, which can itself be formed as a plugging part for the plug connection with insulator 32*a*. In the represented embodiment, the marginal flange 49 of insulator 48 engages over the casing 37*a* of insulator 32*a* over the entire circumference thereof. The two insulators 32*a*, 48 also butt-joint and together form an overall casing, whose casing parts are secured against relative movements by the plugging portions 29*a* engaging in the matching plugs or corresponding, appropriate securing members. Therefore the live parts of the plug connection are also protected against splashed water and the like. As is in particular shown in FIG. 5, the plugging portions 29 are provided on their rear ends with bent leg tongues, with which they engage on the back of casing 37*a* or a corresponding mating surface, so that insulator 32*a* is stop-limited in the end position by said leg tongues in its plugging direction, whilst in the opposite direction it is prevented from moving by the securing members 39*a***.

Figure 8:
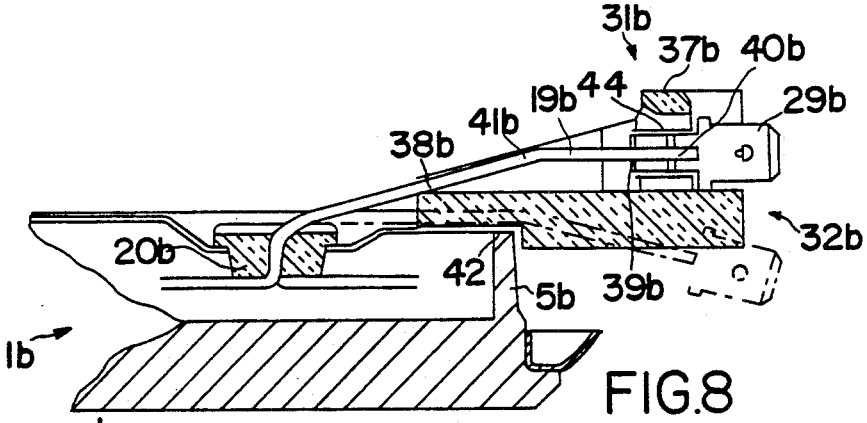
FIGS. 8 and 8*a*: other embodiments in views corresponding to FIG. 4.
Figure 9:
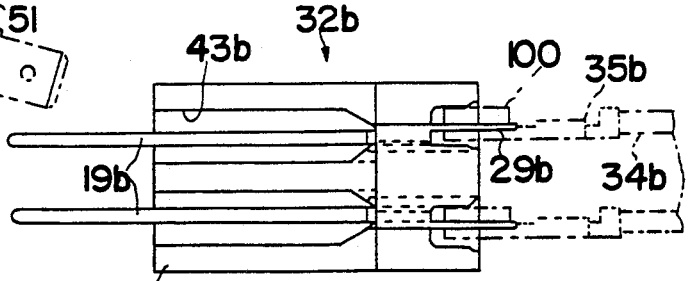
FIG. 9: The connecting means according to FIG. 8 in a view of the underside of the electric hotplate.

In the embodiment according to FIGS. 8 and 9, there is an increase in the thickness of tongue **38*b* on its side remote from step 42, by which casing 37*b* also projects, approximately to the height of said casing 37*b*, so that said grooves 43b have a depth increase towards casing 37b. Whereas in the embodiment of FIGS. 4 to 6, grooves 43 run out before the rear end of tongue 38a, in FIGS. 8 and 9 they extend to the rear end of tongue 38b. Whereas in the embodiments according to FIGS. 1 to 7, the actual plugging portions of plugging pieces 29, 29a project freely over the front of insulator 32, 32a or casing 37, 37a, in the construction according to FIGS. 8 and 9 they are partly housed within casing 37b or insulator 32b, so only the end portions thereof project. It is also conceivable to construct the insulator in such a way that the plugging portions and optionally the matching plugs of the apparatus lines are located completely within the same and are therefore shielded over their entire length and circumference by insulating material. FIG. 8 shows in dot-dash line form the stacking position of the plugging pieces, in which the insulator 32b is moved on to such an extent that it is completely located outside the outer circumference of the outer flange rim 5b. FIG. 9 shows in dot-dash manner the matching plugs 100 of apparatus lines 34b and it can be seen that the insulator 32b for each matching plug 100 forms a funnel-shaped widened insertion opening through which the matching plug 100** can easily assume its precise plugging position and is also secured in the mounted state in non-positive manner against lateral movements.

In the vicinity of weld 40b, plugging piece 29b is provided on its shank portion having the securing member 39b with a type of raised cam 44, which in the represented embodiment is formed by a corrugation at right angles to the longitudinal direction of pin 19b, on either side of which the shank portion can form securing members 39b. The shank portion is located in the same plane as the actual plugging portion of plugging piece 29b.

Figure 10:
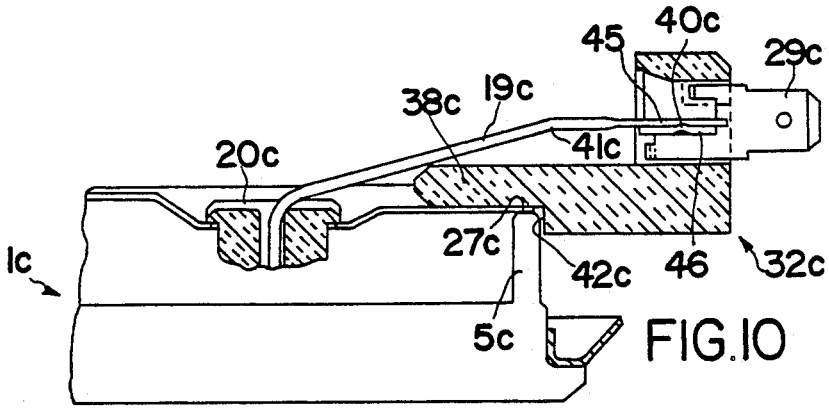
FIGS. 10 and 11: Another embodiment in views corresponding to FIGS. 4 and 5.
Figure 11:
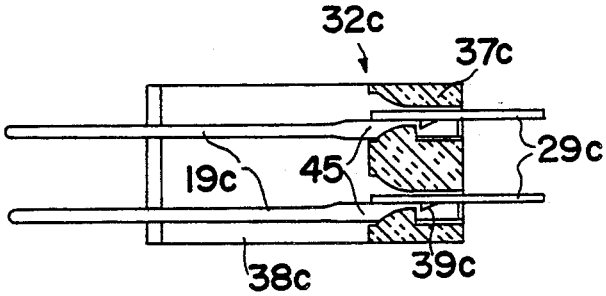

In the embodiment according to FIGS. 10 and 11, the shank portion of each plugging piece 29c is provided with a laterally bent out connecting leg 46 and the end of each connecting pin 19c is constructed by crimping up to its end face as a flattened portion 45, which is parallel to connecting leg 46 and has roughly the same width as the latter. Connecting pin 19c or flattened portion 45 appropriately also engages laterally on plugging portion 29c, although its connecting face is at right angles to the plane of plugging portion 29c.

Figure 12:
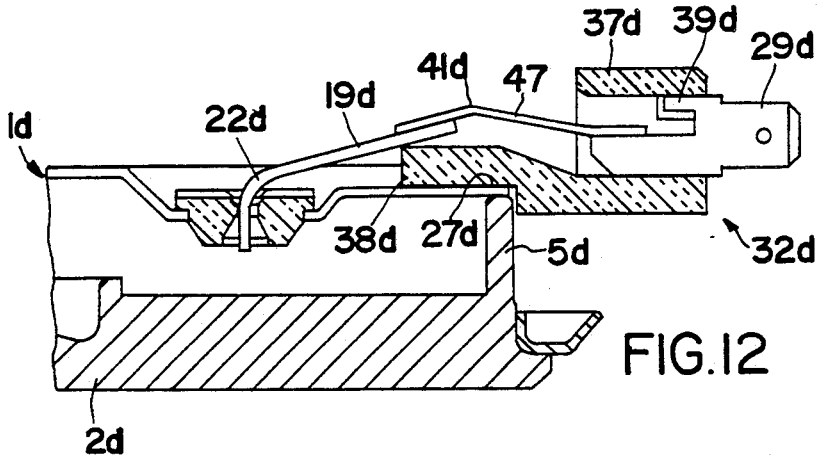
FIGS. 12 and 13: Another embodiment in views corresponding to FIGS. 8 and 9.
Figure 13:
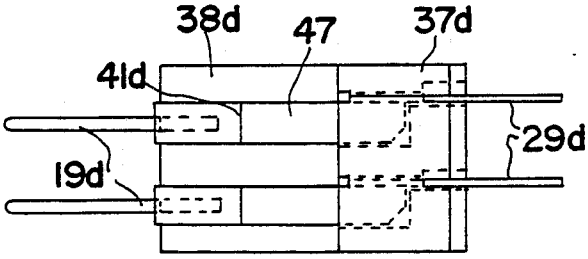

Whereas in the hitherto described constructions the connecting pins are so long that in any position they project over the outer circumference of the hotplate body, in the construction according to FIGS. 12 and 13 they are much shorter, namely so short that substantially in any position they are inwardly displaced with respect to the envelope surface of the inner circumference of the outer flange rim 5d. So that the shank portion of plugging portion 29d for connection to the insulator 32d can still be made relatively short, in this case for connecting said shank portion to the pin 19d a connecting portion 47 is provided, which is formed by a rearwardly projecting extension of connecting leg 46 according to FIG. 10. The connecting portion 47 constructed in the manner of a flat strip-like connecting lug is engaged by its flat side facing hotplate body 2d against the pin 19d and is connected to the latter by a spot weld. In this case, the connecting portion 47 appropriately has three bends 41d, whilst pin 19d is linear throughout from bend 22d to its end face. As is also shown in FIGS. 10 to 13, the reception depression 27c or 27d with respect to the tongue 38c or 38d can also be designed in such a way that said tongue engages in reception depression 27 and engages on the base surface thereof, so that insulator 32c or 32d is additionally secured against lateral movements and can still have a relatively high position.

Whereas in the previously described embodiments there is a single insulator for all the plugging portions, according to FIGS. 14 and 15 a separate insulator 32e is provided for each plugging portion 29e and said insulator can be constructed in the manner of a cross-sectionally flat, rectangular tube. Therefore the same insulator 32e can be used independently of the number of hotplate connections. As shown in FIG. 4, the matching plug 100 receiving the plugging portion 29e is substantially completely located within insulator 32e. Insulator 32e can also be a component preassembled with the matching plug 100 and which is only mounted on plugging the plug 100 on plugging portion 29e. However, insulator 32e could also be longitudinally split in the manner described relative to FIG. 4, so that part is preassembled with plugging portion 29e, whereas the other part is preassembled with matching plug 100 and said two parts are butt-jointed or engage in one another in the assembly position. As can be gathered from FIG. 15, in this case the securing member 39e is provided on matching plug 100 or can be bent out of the same. From the plugging end of matching plug 100, insulator 32e can be so plugged onto the same that it is substantially non-positively secured against movements in both possible directions.

In the embodiment according to FIGS. 16 to 18 the plugging portion 29f is constituted by a bush positionally secured in insulator 32f and whose bush bore is constructed both for receiving the end of connecting pin 19f and for receiving the associated end of the apparatus line. Plugging portion 29f is provided with a radial clamping screw 39f, which simultaneously serves to positionally secure the same and for fixing the flattened portion 45f and the end of the apparatus line. Casing 37f of insulator 32f is provided on either side of the clamping screws 39f with downwardly projecting tongues in the form of lateral webs, so that the heads of the clamping screws 39f accessible between them are shielded against metallic contact.

FIGS. 19 to 25 show various stacking aids 101, but in which despite the different constructions and uses, these drawings essentially use the same reference numerals for corresponding parts. Stacking aid 101 has a plurality of pallet plates 110 to be superimposed and relatively soft or elastic shims 111 to be placed between adjacent stack layers and is essentially carried by a lower support pallet 112. On the latter is arranged a packing sleeve 113 made from a cardboard box 114 with a removable packing lid 115, on whose top surface is to be arranged a clamping plate 116 for bracing the complete packing sleeve 113 against the support pallet 114 using clamping strips 199. Within the packing sleeve 113, the multilayer stack 117 comprises stack layers 118 which, in a grid of rows and columns, receives a plurality of electric hotplates.

The pallet plate 110 forms for the reception of each electric hotplate a flat shell 119 adapted thereto and having a shell bottom 120, whose underside serves as a support surface 121 for providing a support with respect to the next stack layer below it and whose shell jacket 122 receives the associated hotplate in a substantially centred manner, the shell openings 123 being at the top. The depth of the flat shells 119 or each pallet plate 110 having the same height as these is significantly smaller than the installation depth of the associated hotplate, which is essentially defined by the distance between its underside and the bearing ring.

Each pallet plate 110 forms a central plate field 126 receiving the flat shells 119 and is bounded on the outer circumference by a circumferential rim 127. To the inside to the circumferential rim 127 is connected an allround depression in the form of a channel 128, whose bottom 129 is located in the plane of the shell bottoms 120. Circumferential rim 127 forms an outwardly directed rim flange 130. Between adjacent stack layers is appropriately provided a slip preventer 131, which can be formed by giving the shims 111 appropriate characteristics.

Figure 19:
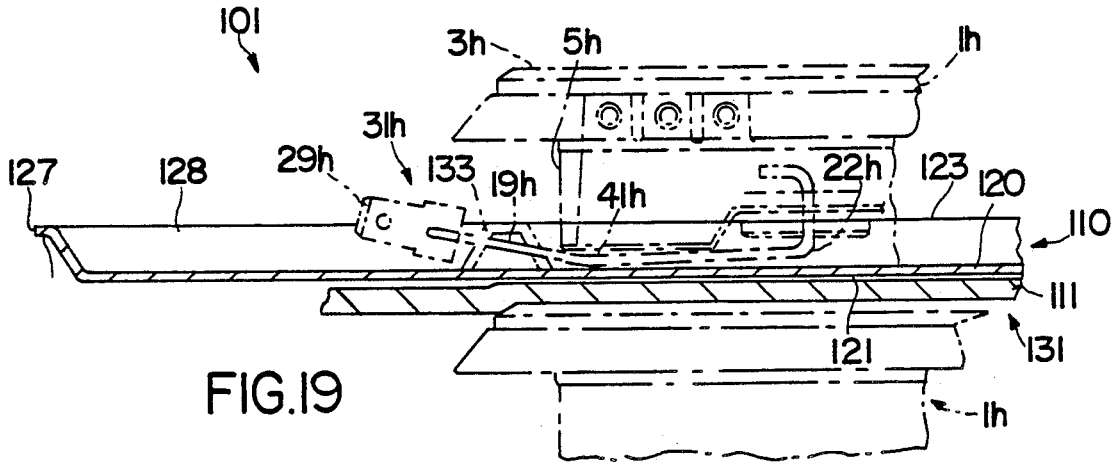
FIG. 19: A detail of an inventive stacking means for stacking electric hotplates according to FIGS. 1 to 3, in cross-section.

The stacking aid 101 according to FIG. 19 is essentially used for stacking electric hotplates 1*h*, which essentially have the same construction as those of FIGS. 1 to 3, but which are not preassembled with an insulator. Superimposed electric hotplates 1*h* are equiaxial to one another and each connecting piece 31*h* is located between boundary planes of the associated hotplate 1*h* adjacent thereto substantially within the associated pallet plate 110. A groove-like recess or depression can be provided in the shell jacket of the associated flat shell and in same the connecting pins engage in such a way that the connecting pieces 31*h* or the associated plugging pieces are located outside said flat shell.

Figure 6:
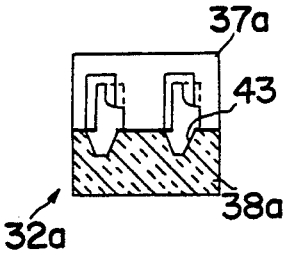
FIG. 6: An insulator for the connecting means in cross-section at right angles to the cooking surface.
Figure 5:
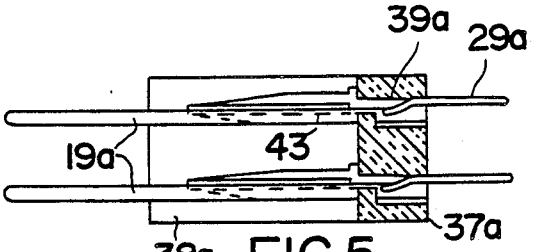
FIG. 5: The connecting means according to FIG. 4 in section parallel to the cooking surface.
Figure 20:
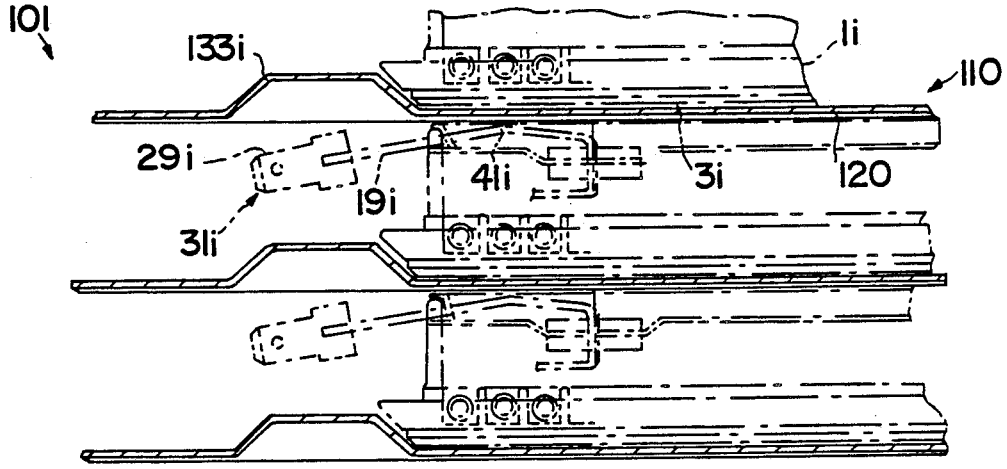
FIG. 20: Another stacking means for the same hotplates in a view corresponding to FIG. 19.

Whereas according to FIG. 19 the electric hotplates 1*h* are stacked in such a way that all the cooking surfaces are at the top, in FIG. 20 the arrangement is reversed, namely in such a way that all cooking surfaces are located at the bottom and which, according to FIGS. 4 to 6, simultaneously represents the assembly position of the hotplates. In this case, the connecting pieces 31*i* are relatively high above the shell bottom of the pallet plate 110 carrying the hotplate 1*i* and they project freely out between two superimposed pallet plates 110.

Figure 23:
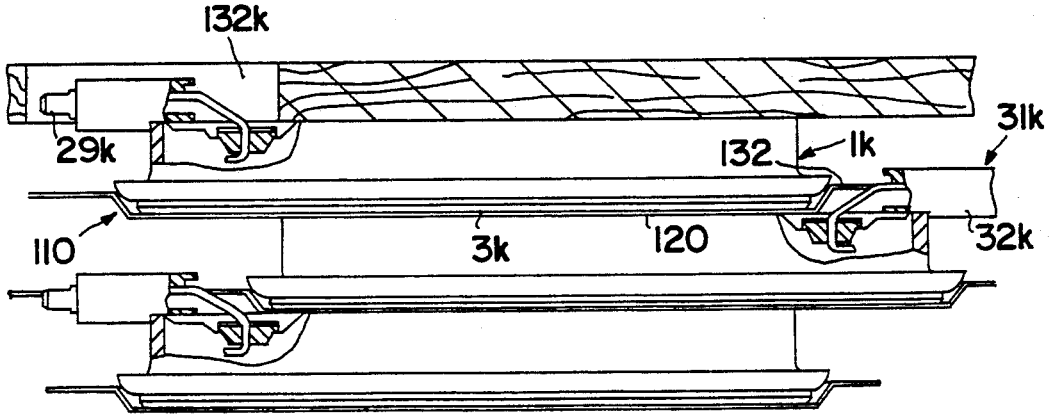
FIG. 23: The stacking means according to FIGS. 21 and 22 in a representation corresponding to FIG. 20.
Figure 21:
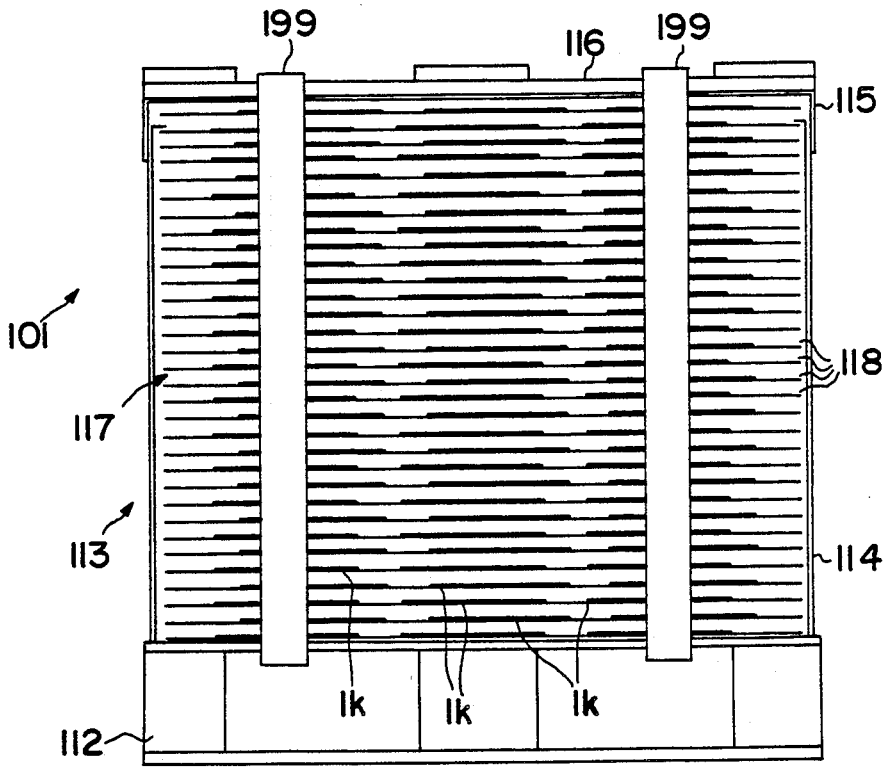
FIG. 21: A stacking means forming a transportation stack in simplified representation.
Figure 22:
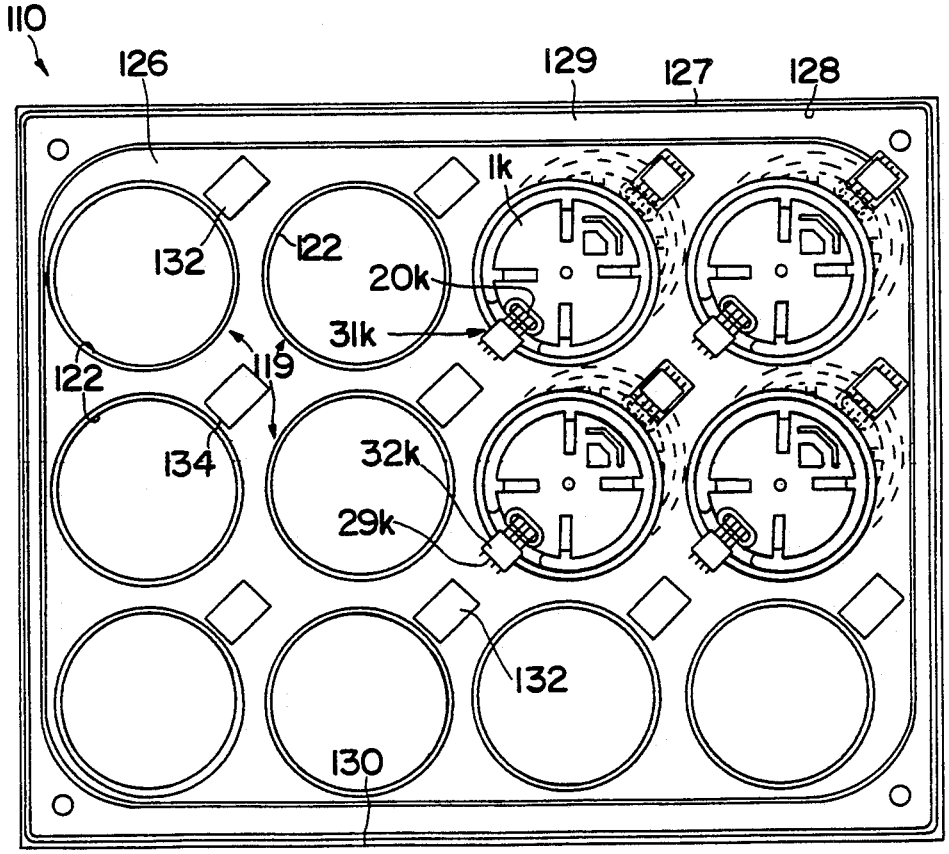
FIG. 22: A plan view of the stacking position of the stacking means according to FIG. 21 in a larger-scale representation.

In the construction according to FIGS. 21 to 23 the arrangement is such that in each case directly superimposed electric hotplates are eccentrically displaced in the direction of a diagonal of the stacking aid 101 which is substantially rectangular in ground plan by an amount approximately corresponding to the distance between insulator 26*k* and the outer circumference of an electric hotplate. The electric hotplates 1*k* stacked upon one another within each stack layer are, however, once again equiaxial to one another. The electric hotplates 1*k* are arranged in such a way that their connecting pieces 31*k* point in the direction in which superimposed hotplates are reciprocally displaced in the described manner and the connecting pieces 31*k* of immediately superimposed hotplates 1*k* displaced in this way point in opposite directions. For the connecting piece 31*k* of each electric hotplate an opening 132 of corresponding size is provided in the pallet plate above it or supported on it and is in each case immediately adjacent to the outer circumference of a flat shell 119 of the pallet plate above it and in which can engage the connecting piece 31*k* of the hotplate 1*k* below it. Thus, in the end position the connecting pieces 31*k* can be joined in finally assembled manner to the electric hotplates 1*k*, without this leading to an increase in the stack height, although the connecting pieces 31*k* project over the undersides of the hotplate at the top.

Figure 24:
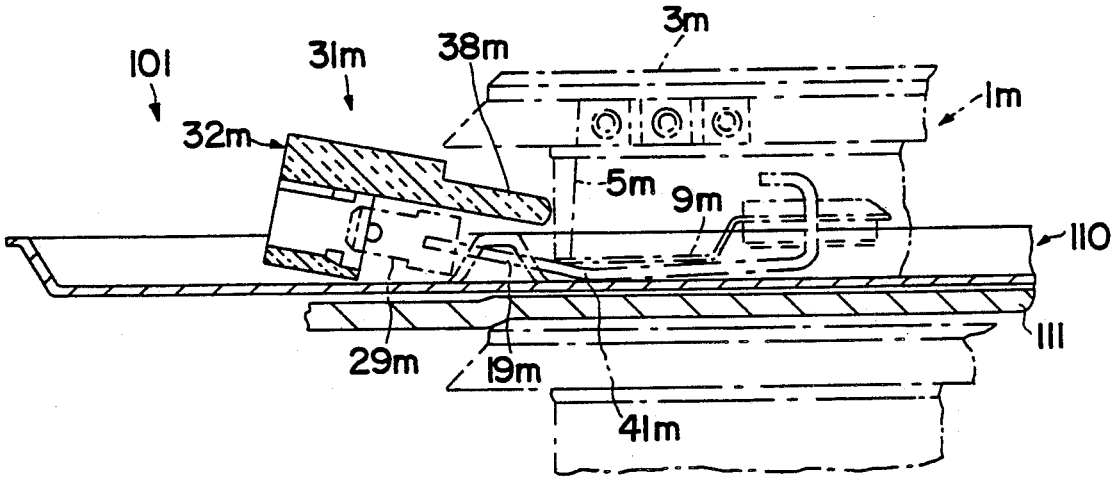
FIGS. 24 and 25: Two further embodiments of stacking means for electric hotplates with insulators in representations corresponding to FIGS. 19 and 20.

FIG. 24 indicates a stacking aid 101, which despite preassembled insulators 32*m*, the electric hotplates 1*m* can be stacked in a very space-saving manner, so that no greater stack height is required than that resulting from the height of the hotplate body, plus the material thickness of the lower covering 9*m*. Insulator 32*m* is only partly mounted on the plugging pieces 29*m*, so that it is completely located outside the flange rim 5*m* and is optionally supported by a tongue 38*m* on the outer circumference of said rim 5*m*. Therefore the entire connecting piece 31*m*, including the insulator 32*m*, can be positioned between the upper and lower boundary planes of the electric hotplate 1*m*. The hotplates 1*m* are, according to FIG. 24, stacked with the cooking surface 31 at the top and in equiaxially superimposed manner.

Figure 25:
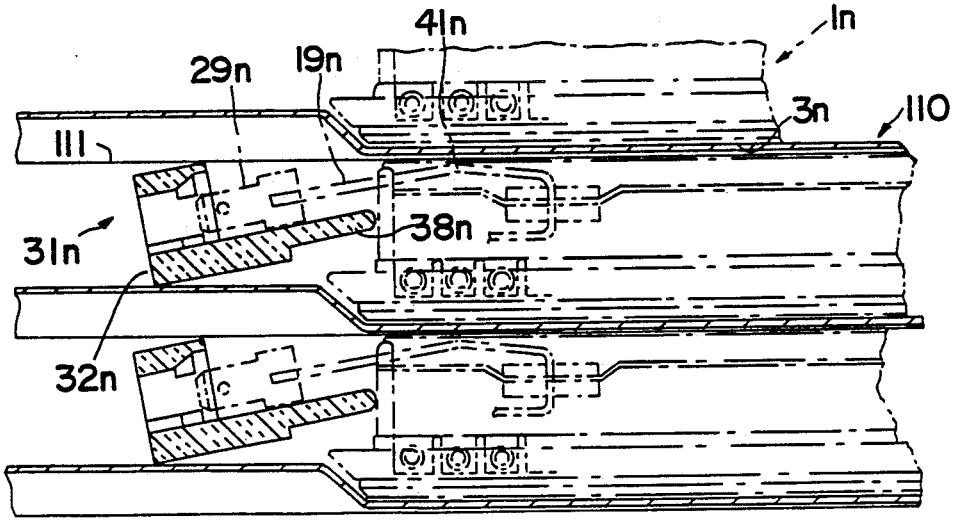

In a comparable manner, according to FIG. 25 the electric hotplates 1*n* are stacked with the cooking surfaces at the bottom. Insulators 32*n* are once again only partly mounted on the plugging pieces 29*n* and are therefore located in the stack position between the boundary planes of the associated hotplate or between the boundary planes of its fitting depth.

According to the invention, as the matching plug can be provided a socket 100 according to FIGS. 26 to 33, so that in conjunction with two or more planar, parallel juxtaposed and identical sockets it can be engaged on plugs 202 in the form of substantially planar flat plugs and can at least in its front region be so enveloped by an insulator 203 that the plugs 202 and corresponding portions of sockets 100 are so enveloped in separate insulating chambers that the plugs 202 are completely located within the insulator 203, so that the desired plug connection 204 is obtained as an electrical connection of an electric hotplate 205. The latter is used for installation in a hob 206 and has a cast iron hotplate body 207, a bearing ring 208 projecting over its outer circumference for support on the top surface of hob 206, on the underside a sheet metal end cover 209, an insulating sleeve 211 fixed in embedded manner therein for the passage of leads 210 and on the hotplate body 207 an outer, jacket-like flange rim 212 traversing the hob 206 in the vicinity of an opening and on which engages the face of the end cover 209 remote from the cooking surface 213.

During the assembly and electrical connection of the electric hotplate 205, according to an inventive procedure it is appropriate to operate in such a way that hotplate 205 with its cooking surface 213 directed downwards and optionally with further hotplates to be fixed in the same hob 206, is placed on a bearing surface and then the hob 206 is mounted in the reversed position on the flange edge 212 of the electric hotplates and braced therewith in such a way that the bearing rings 208 of hotplates 205 are supported under pretension on the use side of hob 206. In the still unturned position or in the use position the sockets 100 are connected with the plugs 202 forming a closed constructional unit with the particular hotplate 205.

The plugs 202 of each electric hotplate 205 are flat components elongated and strip-like in their plugging direction and which with the rear end form a plug shank 214, to which is fixed the free end of the associated lead 210, e.g. by spot welding in laterally overlapping manner, so that the plug 202 is located entirely outside the outer circumference of flange rim 212 or hotplate body 207 or bearing ring 208 and is pivotable about a bending point of lead 210 in the vicinity of insulating sleeve 211 in a plane roughly at right angles to the cooking surface 213. The front, shorter end of plug 202 connected by a short, widened intermediate portion to the plug shank 214 forms the actual plugging member 215, which is directed outwards with respect to the circumference of hotplate 205, projects to the same extent as the plugging members 215 of all the remaining, associated plugs 202 and is parallel thereto, particularly in a plane at right angles to cooking surface 213. Roughly in the centre of its width and the centre of its length, plugging member 215 is provided with a plugging opening in the form of a circular break and has a short plug tip 217 located in front of the plugging opening 216 and which is formed by bevelling both the wide sides and the narrow edges of the plugging member 215.

The flat, rectangular insulator 203 in longitudinal view has substantially planar end faces 218, 219, which are at right angles to its longitudinal direction and which are traversed by a number of linear reception channels 220 for the plugging connections corresponding to the number of plugs 202 or sockets 100. In the side walls of said reception channels 220 are provided narrower, groove-like recesses 221, which extend from the front end face 218 to close to the rear end face 219 and whose transverse wall forming the rear end is in each case suitable as a counterstop 222 for the abutment of the plug connection 204. Counterstop 222 or recess 221 is located roughly in the centre of the width of the associated side wall of the reception channel 220 and has a smaller width than the latter. The cross-section of the reception channel 220 is relatively closely adapted to the outer cross-section of the associated socket 100, so that the latter can engage in an almost transverse clearance-free manner. The widened portion of plug 202 is correspondingly adapted to the associated cross-sectional size of the reception channel 220. At the latest following the production of the plug connection 204, the associated end of lead 210 can be placed in one of the recesses 221.

Plug connection 204 or insulator 203 also has orientation or alignment means with respect to the hotplate body 207 and which in the represented embodiment are formed by a stepped orientation shoulder 223 on the top surface of insulator 203 emanating from the front end face 218 and passing over the width of insulator 203. In accordance with the position indicated in dot-dash line manner in FIG. 26, the outer circumference of the outer flange rim 212 engages in said orientation shoulder 223 in the finally mounted state in such a way that the lower shoulder face of orientation shoulder 223 engages over the electric hotplate 205 on the underside of end cover 209, whilst the shoulder face at right angles thereto can engage on the outer circumference of flange rim 212. Insulator 203 arranged approximately parallel to the cooking surface 213 below hob 206 and in contact-free manner is consequently positioned partly above the underside of hotplate body 207 or cover plate 209 and projects with most of its length outwards from the outer circumference of hotplate 205.

In an advantageous procedure the insulator 203 with the sockets 100 and the associated conducting cables 225 carry at the particular end the said sockets 100 is preassembled or prefabricated. Insulator 203 is mounted to such an extent in its plugging direction according to arrow 224 on plug 202 until the same has reached its plugging position in socket 100 and end portions of the leads 210 within the reception channels 220 engage on plug 202. Insulator 203 has then reached the said installation position, whilst the sockets 100 can partly freely project out of the rear end face 219 of insulator 203. Sockets 100 are secured with respect to insulator 203 in the plugging direction of arrow 224 and counter thereto by stops, whilst they are fixed with respect to plugs 202 by frictional engagement and resilient locking. Only as a result of these means can the insulator 203 be fixed in its installed position.

Figure 29:
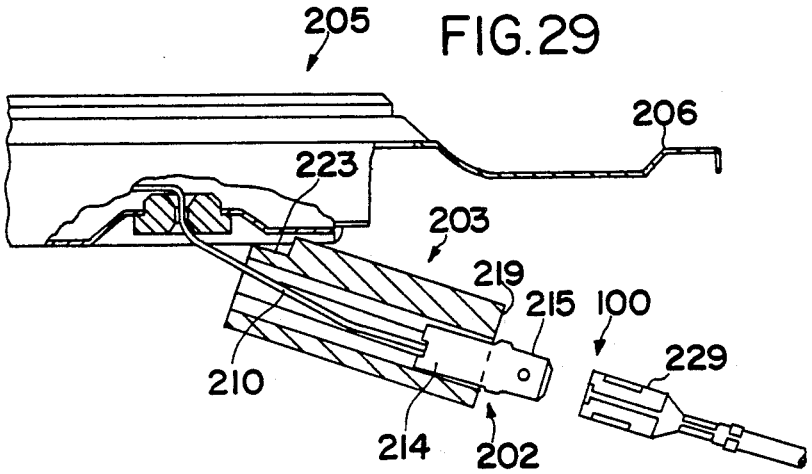
FIG. 29: Another arrangement in a representation corresponding to FIG. 26.
Figure 32:
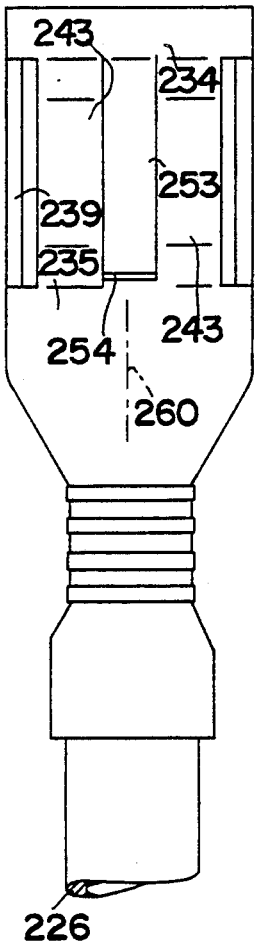
FIG. 32: The socket of FIG. 30 in a view of the back.
Figure 31:
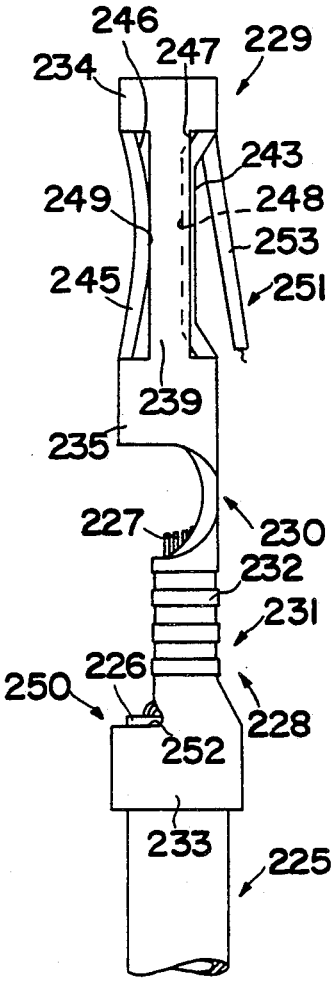
FIG. 31: The socket of FIG. 30 in side view.
Figure 30:
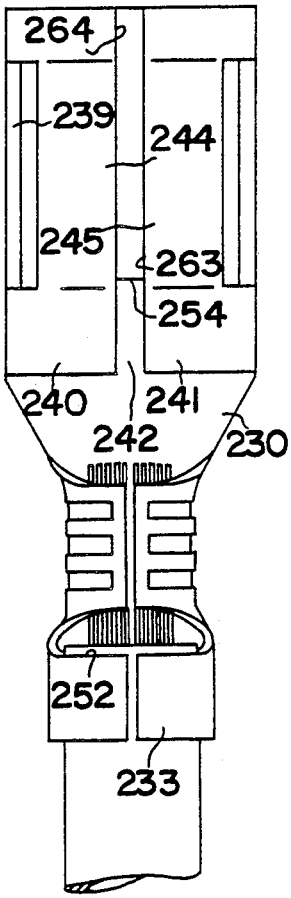
FIG. 30: The socket of FIG. 26 on a larger scale.
Figure 33:
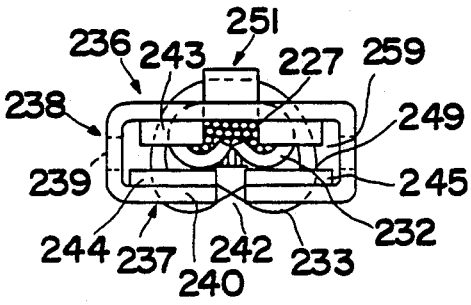
FIG. 33: The socket according to FIG. 30 in a view of the front end.
Figure 36:
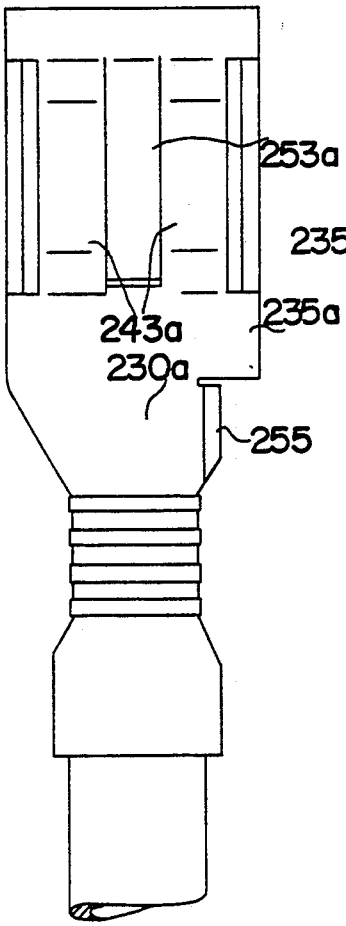
FIG. 36: The socket according to FIG. 34 in a view of the back.
Figure 35:
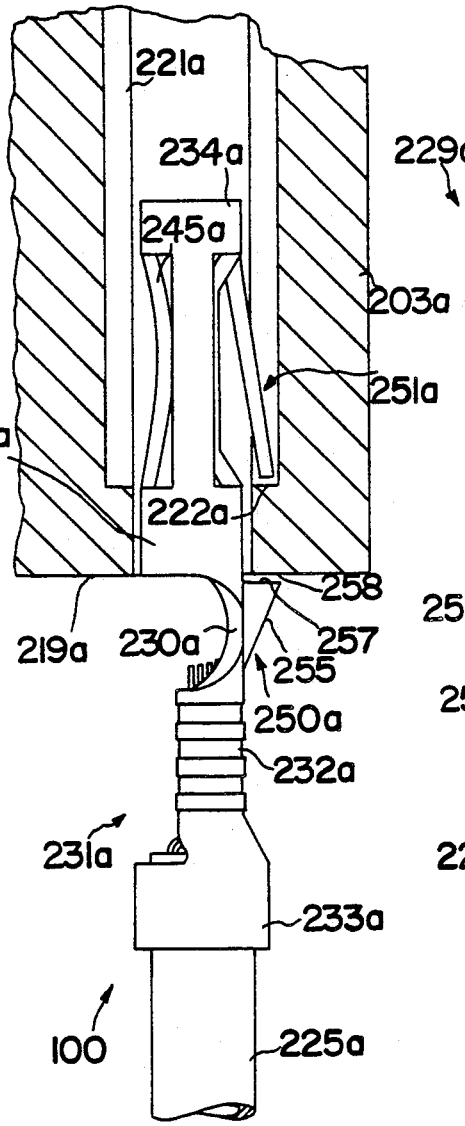
FIG. 35: The socket according to FIG. 34 in side view according to FIG. 31, but in its association with the insulator.
Figure 34:
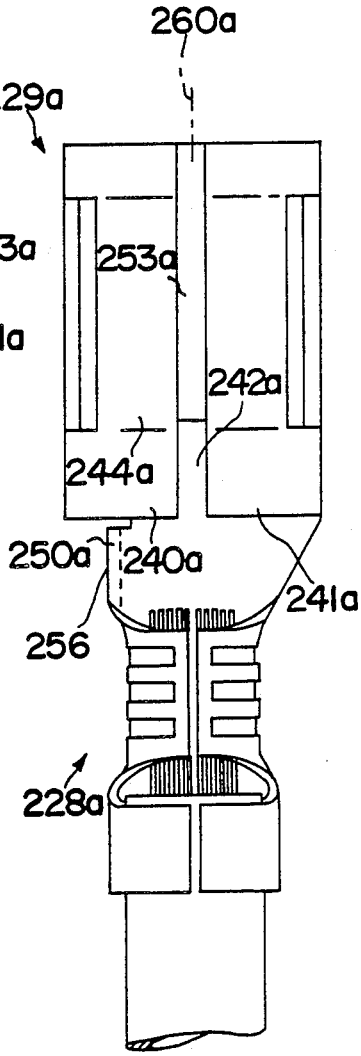
FIG. 34: Another embodiment of a socket in a view corresponding to FIG. 30.
Figure 37:
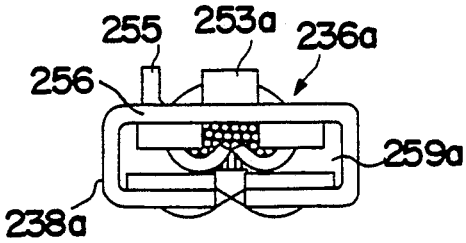
FIG. 37: The socket according to FIG. 34 in a view of the front end.
Figure 40:
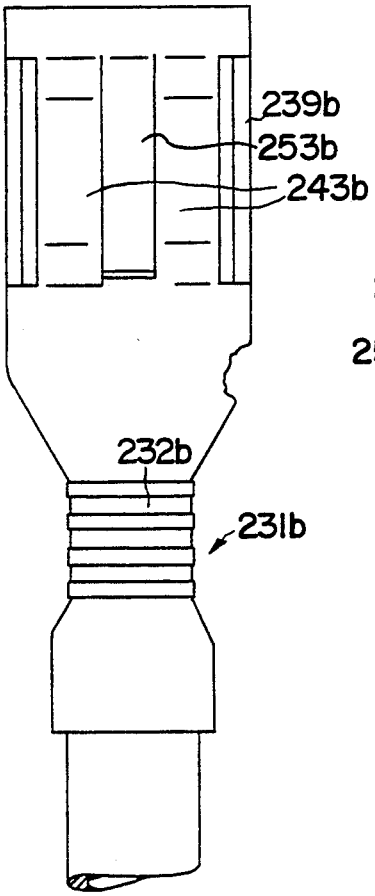
FIGS. 38 to 45: Two further embodiments of sockets in representations corresponding to FIGS. 30 to 33.
Figure 39:
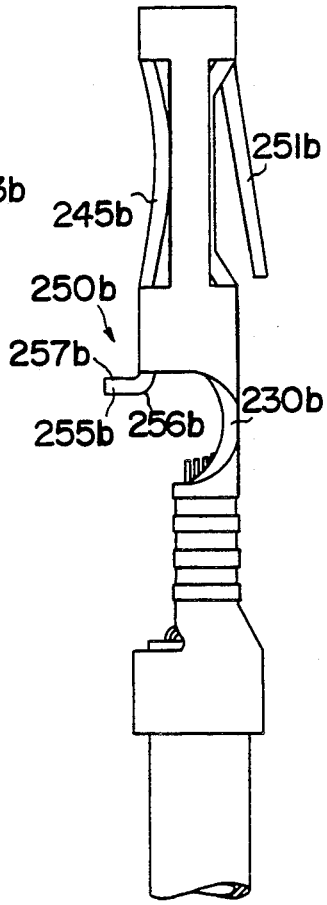
Figure 38:
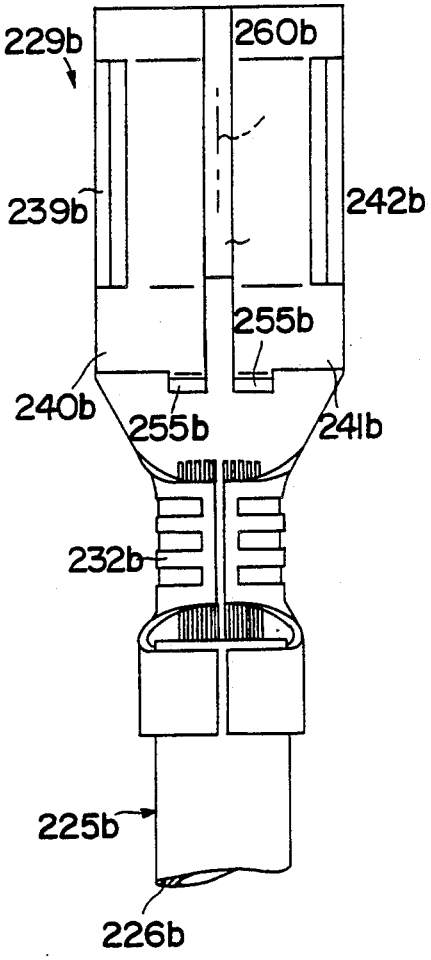
Figure 41:
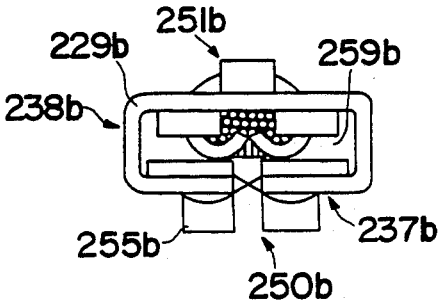
Figure 44:
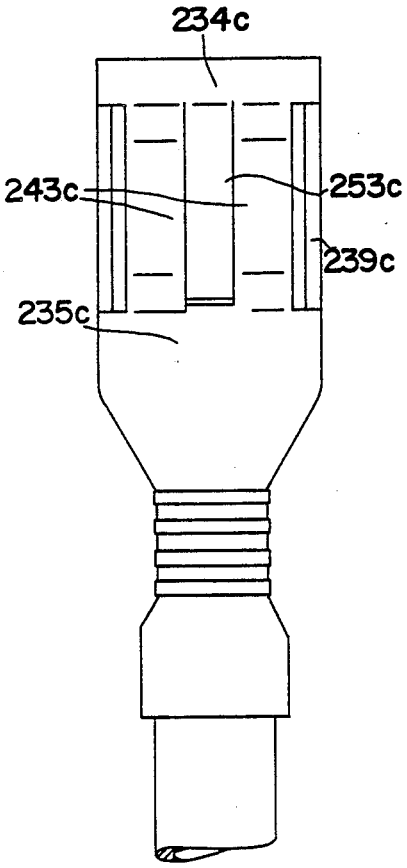

According to FIG. 29 during assembly it is also possible to proceed in such a way that the insulator 203, initially without sockets, is engaged on the plugs 202 and leads 210 until the plug members 215 project over the rear end face 219. The sockets 100 are then engaged separately or simultaneously on plug members 215, after which insulator 203 is either moved back into the installation position described relative to FIG. 26, or is left in the position shown in FIG. 29 and in the latter case insulation of the leads 210 exists approximately over their entire free length below the electric hotplate 205. Insulator 203 and/or the insulating sleeve 211 is appropriately made from a hard, ceramic material, e.g. steatite.

According to FIGS. 30 to 33, the socket 100 is formed by a one-piece, sheet metal socket body 228, whose front end is shaped to form a flat sleeve-like longitudinally slotted plugging part 229 extending over its entire length and whose rear end passes into a transition portion 230, which rearwardly tapers in acute-angled manner. The narrower end of this transition portion 230, which is much shorter than plugging part 229 passes into a crosssectionally, approximately elliptical braided clip 232 of a cable connection shaft 231 tapered compared with the width of plugging part 229 and whose rear end forms a bending clip 223, which is directly connected to the rear end of the braided clip 232, but is wider than the latter, but has a smaller width than that of plugging part 229. Braided clip 232 is used for clipping round the bundle on cable strand 227, which projects freely of the insulating material cable jacket 226 of the conducting cable 225, the front end of cable jacket 226 being surrounded by the bending clip 233. The clip legs of the particular clip are directed inwards and consequently claw-engaged in the cable strands 227 or cable jacket 226. The longitudinal slots between the clip legs of both clips and the single through longitudinal slot of the plugging part 229 are located in a common median longitudinal plane.

At the front end, plugging part 229 forms a front end portion 234 interrupted only by the single, through longitudinal slot and whose length is smaller than the thickness of plugging part 229 and a corresponding rear end portion 235, which is longer than the front end portion 234. These two end portions 234, 235 are interconnected by an intermediate portion, which is subdivided by further longitudinal slots, apart from the aforementioned longitudinal slot, so that on each flat side 236 or 237 of plugging part 229 there are two juxtaposed longitudinal webs displaced inwards with respect to the narrow sides 238 and on the latter is in each case formed a single longitudinal web 239, whose width is less than that of the substantially planar narrow side 239 and located in the centre of the latter.

On a flat side 237 plugging part 229 forms two substantially mirror symmetrical sleeve legs 240, 241, which are planar in the vicinity of the end portions 234, 235, which are located in a common plane and whose longitudinal edges 263, 264 formed by the cutting edges define said through longitudinal slot 242. On said flat sides 236, 237, over whose planes only project the bending clip 233 of the cable connection shaft 231, all said longitudinal webs form plug or contact springs 243, 244, 245, which are shaped inwards out of the plane of the particular associated flat side, are located parallel to the longitudinal direction of plugging part 229, have the same length and on the particular flat side 236 or 237 are also equally wide. In addition, their front ends pass over the full width in one piece into the front end portion 234 and with their rear ends into the rear end portion 235. The remote longitudinal edges of the constant width contact springs 243, 244, 245 of each flat side are displaced inwards with respect to the associated narrow side 239 by an amount which is larger than the sheet metal thickness of the socket body 228. The parallel, facing longitudinal edges of the corresponding contact springs 243 or 244, 245 are at a distance from one another, which is at the most as large as their width.

The two contact springs 243 provided on the flat side 236 facing the longitudinal slots 242 are bent in obtuse-angled manner at both ends and between said ends have a linear or planar intermediate portion connected in angular manner to the end portions 234, 235 and which is inwardly displaced with respect to the associated flat side 236 in such a way that it engages between the longitudinal webs 239, but is contact-free with respect thereto. This leads to the formation of a tip or apex parallel to the plugging direction having a length which is significantly larger than half the length of the intermediate portion located between the end portions 234, 235. However, the contact springs 244, 245 are so shallowly inwardly curved that their convex, inner curvature side in each case forms a linear apex or tip 249 passing over their entire width, but which is not displaced as far inwards as the tip 248 of contact springs 243. Tips 248, 249 are symmetrical to the centre of the length of said intermediate portion. As a result of the described construction the front ends of the contact springs 243, 244, 245 with their insides form insertion bevels 246, 247 for the plugs 202, which are located approximately parallel to the associated flank surfaces of the plug tip 217. Moreover, the contact springs 243, 244, 245 are completely located within the planar outer surfaces of the plugging part 229 and tensile stress the longitudinal webs 239 accompanied by widening.

Figure 26:
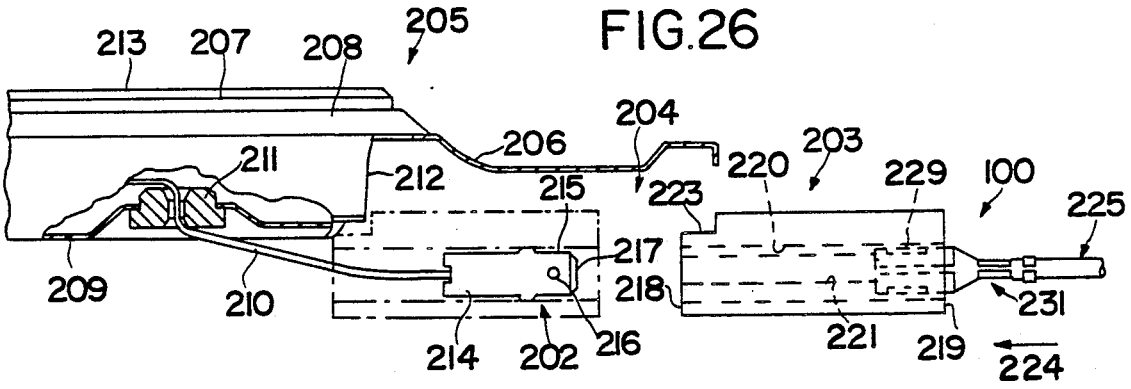
FIG. 26: A socket in an inventive association with a hotplate in a part sectional side view.
Figure 28:
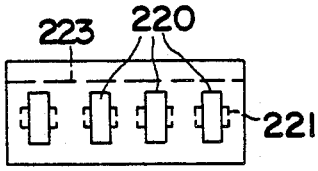
FIG. 28: The insulator of FIG. 27 in a view from the right.
Figure 27:
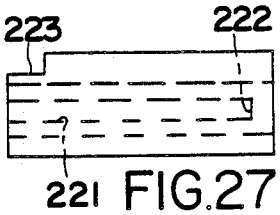
FIG. 27: The insulator according to FIG. 26 in side view.

For the indicated stop securing purposes with respect to the insulator 203, in the case of the embodiment according to FIGS. 30 to 33 an advance stop 250 and a withdrawal stop 251 are provided. The advance stop 250 is essentially formed by the front edge or end face 252 of the clip legs of the bending clip 233, which according to FIG. 33 project over the plane of the associated flat side 237 and with which is associated a corresponding counterstop at the rear end of the insulator 203 and which in the case of corresponding extension of insulator 203 can be formed by its rear end face 219, so that all that projects therefrom are the bending clips 233 of sockets 100 and not, as shown in FIG. 26, the rear end portions 235 and the cable connecting shafts 231. Therefore optionally the front end of the cable jacket 226 also projects slightly into the insulator.

Withdrawal stop 251 is constructed in the manner of a resiliently deflectable snap member as a planar spring tongue 253, which on the flat side 235 is partly positioned between the contact springs 243 and has a width which is substantially the same as the intermediate spacing between contact springs 243. The continuously linear or planar spring tongue 253 passes via an obtuse-angled bend from the rear edge of the front end portion 234, so that it is substantially completely located outside the plane of the associated flat side 236 and extends approximately over the entire length of the contact springs 243, 244, 245, its free terminal edge 254 being provided roughly in the plane of the front terminal edge of the rear end portion 235. Spring tongue 253 can be resiliently completely pressed into the plane of flat side 236, its outside forming a run-up bevel on inserting the socket into insulator 203 until the terminal edge 254 jumps as a stop face behind the counterstop 222. The advance stop 250 is located roughly in the plane of the flat side 237 facing the withdrawal stop 251. Both the stops are completely located outside the boundary planes of the cross-sectionally flat rectangular plugging opening 259 of plugging part 229, into which only project the contact springs 243, 244, 245. All the stops 250, 251 are symmetrical to the median longitudinal plane 260 of plugging part 229 at right angles to the flat sides 236, 237.

In FIGS. 34 to 45 corresponding parts are given the same reference numerals as in the other drawings, but are provided with different letter references, the corresponding description parts applying accordingly.

In the embodiment according to FIGS. 34 to 37 the advance stop 250*a* is positioned in front of the bending clip 233*a* or the stranded or braided clip 232*a* in the vicinity of the transition portion 230*a*, so that its stop face 257 is located roughly in the plane of the rear edge of the rear end portion 234*a* or the sleeve legs 240*a*, 241*a*. Stop 250*a* is formed by a substantially planar web 255, which projects at right angles over the same flat side 236*a* as the withdrawal stop 251*a*. Stop 255, which is bent out of the substantially planar transition portion 230*a*, is inwardly displaced with respect to the adjacent narrow side 238*a* by roughly half the width of the associated sleeve leg 240*a* and is thus formed by the bent edge of the transition portion 230*a*, so that its back edge is formed by the associated sloping lateral edge of transition portion 230*a* and drops away in sloping manner rearwards from the stop face 257. Web 255 is bent along a bending edge 256 parallel to the median longitudinal plane 260*a* or the plugging direction. The rear end face 219*a* of insulator 203*a* is associated with the advance stop 250*a* as a counterstop 258.

In the embodiment according to FIGS. 38 to 41 the advance stop 250*b* is substantially formed by the rear end portion 235*b*, but is bent by a bending edge 256*b* which is at right angles to the median longitudinal plane 260*b*, so that its stop face 257*b* is formed by the inner flat side of at least one bent leg 255*b*. Stop 250*b* is symmetrical to the median longitudinal plane 260*b* on either side of the longitudinal slot 242*b* and is formed by two legs 255*b* extending laterally up to said longitudinal slot 242*b* and bent from the rear ends of the sleeve legs 240*b*, 241*b* and whose width is substantially less than that of the sleeve legs 240*b*, 241*b*, so that they are laterally set back with respect to the narrow sides 238*b* and have an overall width which is only at the most as large as the corresponding width of the braided clip 232*b*. Stop 250*b* is the part of the complete socket body 228*b* projecting furthest over the plane of the associated flat side 237*b*.

FIGS. 42 to 45 show an inventive construction, which can be individually provided on a socket without the described stop arrangement. For the locking engagement in the plug opening 216 of plug member 215, plugging part 229*c* is provided between the end portions 234*c*, 235*c* on the associated intermediate portion with a spring cam 261, which is located on one of the said longitudinal webs, namely preferably on one of the contact springs. In the represented embodiment the spring cam 261 is located on a sleeve leg 241*c* and namely on a projection 262 projecting over its otherwise linear longitudinal edge 263c and whose edge is rounded in a substantially semicircular manner and passes in concavely rounded manner into the adjacent linear portions of the longitudinal edge 263c. Spring cam 261 is stamped in a circular or spherical cup-shaped manner from projection 262 in plugging opening 259c in such a way that it is located in longitudinal slot 242c, which in the vicinity of spring cam 261 can form a correspondingly curved slot portion 265, although it is also conceivable for projection 262 or spring cam 261 to engage below the facing longitudinal web in the vicinity of a corresponding shaped out portion and so as to be supported by its spring action.

The longitudinal web carrying the spring cam 261 in the represented embodiment has both the leaf spring-like action of contact spring 245c and the action of a cam spring for the spring cam 261 located between its ends and closer to the front end and which projects over the associated tip 249c. Although spring cam 261 is located in the vicinity of tip 249c, it is so forwardly displaced with respect thereto that the tip or vertical line is substantially in contact with its circumference. Therefore the spring cam 261 is located in the vicinity of the insertion bevel 246 immediately adjacent to tip 249c, so that the cam axis 266 is under a rearwardly opening angle of slightly less than 90° to the plugging direction and the front circumferential area of spring cam 261 forms a more strongly rising extension portion of insertion bevel 246c.

Figure 43:
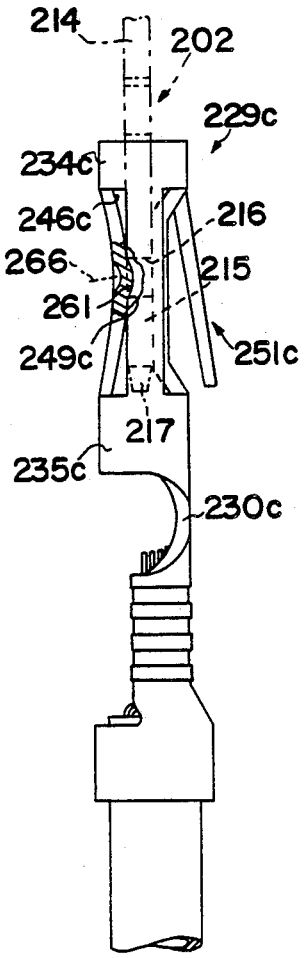
Figure 42:
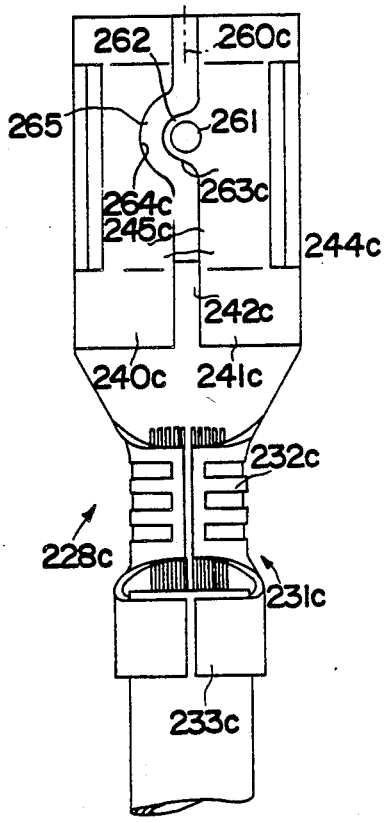
Figure 45:
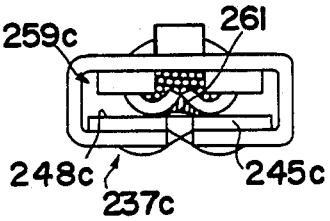

FIG. 43 shows in dot-dash line manner the plug 202, whose plug tip 217 in the plugged-in state substantially only extends up to the front end of the rear end portion 265c and engages in its plug opening 216 of spring cam 261. A corresponding spring cam could be provided on the opposite side which, if no withdrawal stop 251c is provided, can be directly formed by the associated flat side.

Figure 8A:
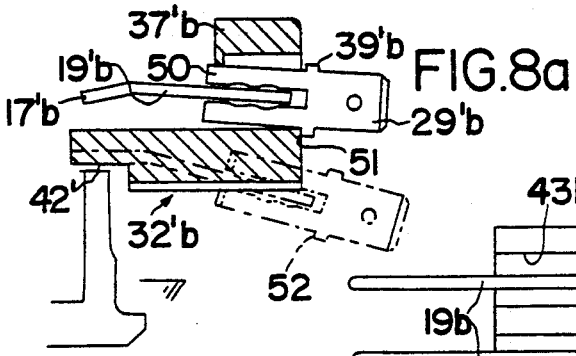

The embodiment according to FIG. 8a comprises a plugging piece 29'b similar to that one according to FIG. 8. This plugging piece has a shaft 50 arranged in a plane of the plugging piece and reduced in width to a dimension which can be substantially equal to the width extension of the flat plug, thereby providing substantially aligned longitudinal edges of the shaft 50 and the flat plug. Between the flat plug and the shaft 50 there are provided lugs 39'b projecting over said longitudinal edges and being constructed in one piece with the plugging piece 29'b. The lugs 39'b projecting on either side of the shaft 50 are arranged in a common plane of the shaft and the flat plug. A through opening providing an insertion opening for plug-like inserting the plugging piece 29'b is provided in the casing 37'b of insulator member 32'b for each single plugging piece. This through opening is substantially adapted to the plugging piece 29'b in cross section, the larger cross-sectional extension being narrowly adapted to the distance between the remote edges of the lugs 39'b in such a way that it is just possible to slide them through the through opening.

After the plugging piece 29'b or all associated respective adjacent plugging pieces of the hotplate have been swung out of their transporting position shown in dash-dotted lines in FIG. 8a, the insulator member 32'b can be pluggingly inserted over the plugging pieces in a direction counter to the projecting direction of the plugging ends of the plugging pieces, i.e. from an outside towards the hotplate or the middle axis thereof. During this operation the protrusions or lugs 39'b slide through the through opening of casing 37'b until they arrive at the outer end face thereof. Because of the return spring characteristics of the associated lead 17'b, the plugging piece 29'b will snap at this point into a position not truly aligned with the associated through opening of casing 37'b and in this position the one or other lug 39'b will engage behind this end face in a barbed manner. The corresponding lateral edge of each lug 39'b which is associated to this end face is shaped in an undercut or hook-like inclined manner and for each lateral edge 52 for each lug 39'b is provided a recess 51 in the associated end face of casing 37'b. The recess 51 is located directly adjacent to the through opening and has an accordingly inclined bottom face adapted to the inclination of the lateral edge 52. The stop face provided by the end face of casing 37'b may also be formed by a shoulder of a recess to provide the stop face inside the casing.

Because of the fact that the insulator member 32'b in its mounting position is supported against radially inside directed movement with respect to the hotplate, e.g. by the step 42' and eventually by a certain longitudinal resilient tension of the lead 17'b the stop oriented lug 39'b will be forced into its securing position in a direction transverse to the plugging direction of the plugging piece by means of the interengaging inclined faces. Depending on the direction of two opposite directions in which the lead 17'b will be biased in the return-spring manner either the one or the other lug 39'b will come into engagement with the associated recess 51. In each case the insulator member 32'b will not have the possibility to accidentally be detached, especially since usually the insulating member 32'b will be secured by a plurality of individually spring biased plugging pieces. Furthermore, the lugs 39'b provide stops for a plugging socket to be plugged on the flat plug.

We claim:

1. A stacking aid for hotplates having a hotplate body with a cooking face and a plugging piece for connection to connecting members of an electrical supply line, the stacking aid being adapted for receiving a plurality of hotplates in a multilayer stack, said stacking aid comprising:

pallet plates containing receptacles for receiving said plugging pieces of each single hotplate, the receptacles being laterally outside of said each single hotplate in said plurality of hotplates.

2. The stacking aid as recited in cliam 1 wherein the pallet plates are shaped such that when assembled to form said multilayer stack said hotplates are stacked equiaxially to one another with the plugging pieces disposed in respective ones of the receptacles and said receptacles are located between boundary planes at the associated hotplate adjacent thereto substantially within the associated pallet plate.

3. The stacking aid as recited in claim 1 wherein the receptacles are disposed on one side of the pallet plates such that when assembled to form said multilayer stack, cooking faces of said hotplates are oriented up.

4. The stacking aid as recited in claim 1 wherein the receptacles are disposed on one side of the pallet plates such that when assembled to form said multilayer stack, cooking faces of said hotplates are oriented down.

5. The stacking aid as recited in claim 1, further comprising a lower support pallet to carry said stacking aid.

6. The stacking aid as recited in claim 5, further comprising shims to be placed between layers of said multilayer stack.

7. The stacking aid as recited in claim 6, further comprising a cardboard packing sleeve with a removable lid, said lid having a clamping plate for bracing said sleeve against said lower support pallet using clamping strips.

8. The stacking aid as recited in claim 1, wherein said pallet plates each form a flat shell with a shell jacket and a shell bottom said shells having an outer circumference, said jacket receiving the hotplate in a substantially centered manner.

9. The stacking aid as recited in claim 8, wherein said shell has a depth significantly less than an installation depth of the associated hotplate.

10. The stacking aid as recited in claim 8, wherein said shells are bounded on said outer circumference by a circumferential rim, said rim having an inside, encircling the shell to the inside of the rim is a depression in the form of a channel, said channel having a bottom located in a plane of said shell bottom, said rim forming an outwardly directed rim flange.

11. The stacking aid as recited in claim 8, further comprising a groove-like depression in said shell jacket for accommodating said plugging pieces outside of said flat shell.

12. The stacking aid as recited in claim 8, wherein each said pallet plate contains a plurality of flat shells arranged in rows and columns along the plane of said pallet plate, the pallet plate being of substantially rectangular shape, said receptacles being aligned in a direction of a diagonal of said pallet plates with said receptacles on adjacent layered pallet plates pointing in directions 180 degrees opposite.

13. The stacking aid as recited in claim 10, wherein said hotplates have an insulator partly mounted on said plugging piece, the stacking aid, when assembled, having said plugging piece completely located outside said rim flange and said plugging piece, including said insulator, positioned between the upper and lower boundary planes of the hotplate, the hotplate having a cooking face and a bottom surface, the boundary planes defined by horizontal planes extending from said cooking face and bottom surface.

14. The stacking aid as recited in claim 10, further comprising a means to prevent slippage located between layers of said multi-layered stack.

15. The stacking aid as recited in cliam 12, wherein the hotplates have undersides, further comprising openings defining receptacles sized to fit said plugging pieces, said openings individually located in the pallet plate above the hotplate, or supported on said pallet plate above, said openings immediately adjacent to said outer circumference of said flat shell of said pallet plate above, said openings engageable with said plugging pieces so that when assembled said plugging pieces project over the underside of the hotplate above.

16. The stacking aid as recited in claim 13, further comprising a tongue on said outer circumference of said rim to support said insulator.

* * * * *